US007082706B1

(12) United States Patent
Stinis et al.

(10) Patent No.: US 7,082,706 B1
(45) Date of Patent: Aug. 1, 2006

(54) SYSTEMS AND METHODS FOR CREATING AERIAL MESSAGES

(75) Inventors: Gregory Stinis, Cypress, CA (US); Stephen G. Stinis, Channel Islands, CA (US); Curtiss T. Stinis, Irvine, CA (US)

(73) Assignee: Skytypers, Inc., Las Vegas, NV (US)

( * ) Notice: Subject to any disclaimer, the term of this patent is extended or adjusted under 35 U.S.C. 154(b) by 713 days.

(21) Appl. No.: 09/874,565

(22) Filed: Jun. 5, 2001

(51) Int. Cl.
*G09F 21/16* (2006.01)

(52) U.S. Cl. ..... 40/213; 345/156; 701/33; 318/16

(58) Field of Classification Search ..... 345/156; 343/35; 701/33; 40/213; 318/16
See application file for complete search history.

(56) References Cited

U.S. PATENT DOCUMENTS

| | | | | |
|---|---|---|---|---|
| 1,986,942 | A | 1/1935 | Remey | |
| 2,345,152 | A | 3/1944 | Remey | |
| 2,674,820 | A | 4/1954 | Hansen et al. | |
| 3,089,271 | A | 5/1963 | Copeland | |
| 3,114,214 | A | 12/1963 | Pike et al. | |
| 3,151,410 | A | 10/1964 | Stinis | |
| 4,122,618 | A | 10/1978 | Gay | |
| 4,561,201 | A | 12/1985 | Sanborn | |
| 4,635,030 | A * | 1/1987 | Rauch | 340/945 |
| 4,814,711 | A * | 3/1989 | Olsen et al. | 324/331 |
| 4,995,101 | A * | 2/1991 | Titterton et al. | 398/125 |
| 5,883,586 | A * | 3/1999 | Tran et al. | 340/945 |
| 5,932,978 | A * | 8/1999 | Geyer | 318/16 |
| 5,992,065 | A | 11/1999 | Preiser | |
| 6,314,366 | B1 * | 11/2001 | Farmakis et al. | 701/201 |
| 2002/0171039 | A1 * | 11/2002 | Bennett | 250/330 |
| 2004/0119748 | A1 * | 6/2004 | Kopitzke et al. | 345/764 |

* cited by examiner

*Primary Examiner*—Alexander Eisen
*Assistant Examiner*—Kimnhung Nguyen
(74) *Attorney, Agent, or Firm*—Knobbe Martens Olson & Bear LLP

(57) ABSTRACT

Systems and methods are disclosed for creating aerial messages using multiple aircraft. Each of the aircraft includes a control box located in the aircraft for receiving data from and transmitting data to a software program running on a main computer. The systems and methods employ a wireless network to transmit and receive data between the aircraft and the software program, with each aircraft (or its respective control box) representing a node on the wireless network. Additionally, the systems and methods may operate on remote controlled devices, such as miniature remote controlled aircraft, and may be used to produce colored aerial messages. The systems and methods may be used to create an aerial vapor screen capable of displaying projected images. Also disclosed are various methods, systems and user interfaces for creating character libraries (including graphical image libraries and various language libraries), printing aerial messages, tracking system parameters (including message, system and/or aircraft parameters) and accounting of the messages created and printed.

40 Claims, 34 Drawing Sheets

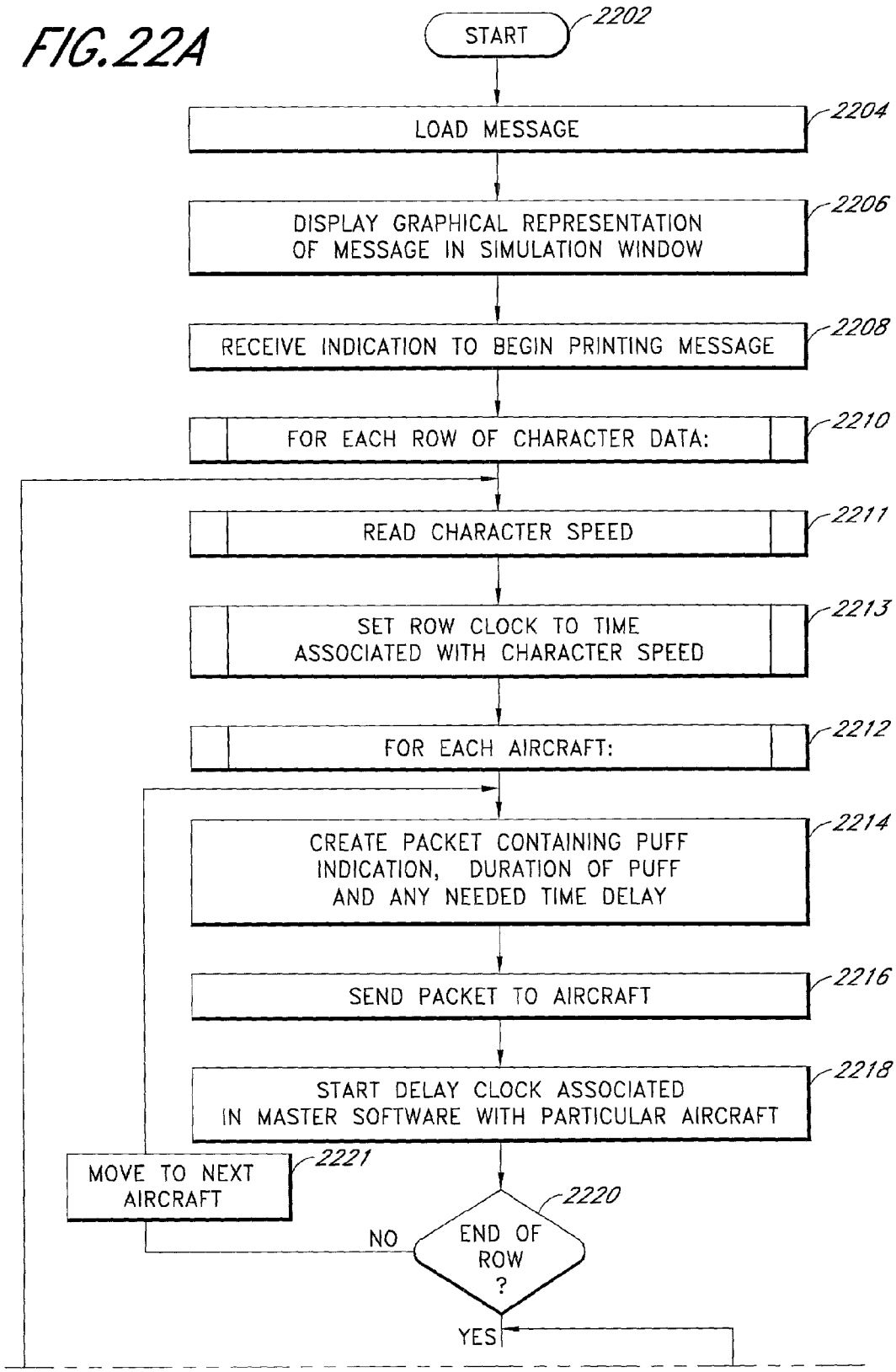
FIG. 22A
START
2202
LOAD MESSAGE
2204
DISPLAY GRAPHICAL REPRESENTATION OF MESSAGE IN SIMULATION WINDOW
2206
RECEIVE INDICATION TO BEGIN PRINTING MESSAGE
2208
FOR EACH ROW OF CHARACTER DATA:
2210
READ CHARACTER SPEED
2211
SET ROW CLOCK TO TIME ASSOCIATED WITH CHARACTER SPEED
2213
FOR EACH AIRCRAFT:
2212
CREATE PACKET CONTAINING PUFF INDICATION, DURATION OF PUFF AND ANY NEEDED TIME DELAY
2214
SEND PACKET TO AIRCRAFT
2216
START DELAY CLOCK ASSOCIATED IN MASTER SOFTWARE WITH PARTICULAR AIRCRAFT
2218
MOVE TO NEXT AIRCRAFT
2221
END OF ROW ?
2220
NO
YES

SYSTEMS AND METHODS FOR CREATING AERIAL MESSAGES

FIELD OF THE INVENTION

The present invention relates to the creation of aerial messages, and more specifically, relates to systems and methods for controlling and coordinating the creation of aerial messages using a plurality of aircraft.

BACKGROUND

Skywriting, one of the oldest methods of creating aerial messages, is the process by which a single aircraft emits a continuous or nearly continuous biodegradable vapor trail while twisting and turning to "write" each letter in the sky. The aerial messages produced by skywriting, which are capable of being seen from the ground for many square miles, provide a dramatic way for companies to advertise their products or services. However, the popularity of widespread skywriting is limited by several factors, including the risks involved in making the aerobatic twists and turns inherent in skywriting, the high degree of aviator skill required to make such precise maneuvers, and the substantial costs in creating even short aerial messages. Additionally, the length of aerial messages created using skywriting techniques is limited because strong winds may blur or dissipate the beginning letters of a long message before the aviator can make all of the twists and turns necessary to complete the message, thereby lessening the otherwise dramatic effect of the aerial message.

To improve the feasibility and ease of creating aerial messages, aviators began using multiple aircraft flying in formation to create messages, with each aircraft emitting short "puffs" of vapor or smoke in a defined pattern to form the individual characters (e.g., letters, numbers, etc.) of the messages. The resulting messages, which are created within a single pass, look like the printouts from a low resolution dot-matrix printer, with individual characters being formed by a pattern of vapor puffs that resembles the pattern of ink dots produced on paper by a dot-matrix printer. Thus, rather than "writing" aerial messages using only a single aircraft, the messages are "printed" in the sky using five or more aircraft, with each aircraft contributing a portion of each character. In order to accomplish the coordination necessary between the multiple aircraft, a master or lead aircraft uses a transmitting device to transmit a plurality of discrete tones or radio signals to the remaining (i.e., receiving) aircraft. These receiving or slave aircraft emit vapor puffs in response to the radio signals received from the master aircraft.

Although an improvement over traditional skywriting techniques, several problems are commonly encountered by existing systems. For example, in order to rearrange two slave aircraft into different positions in a flight formation, existing systems require that the pilots of the two aircraft mutually agree via their radio system to switch positions and then physically adjust their respective receivers to receive the signal originally intended for the other aircraft. Additionally, because the receiving units in each slave aircraft are configured to receive discrete radio frequencies, the units are not easily interchangeable into other slave aircraft.

SUMMARY

The present invention provides systems and methods for the creation of aerial messages using multiple aircraft, where each aircraft emits discrete puffs of vapor to form portions of the aerial message. The resulting pattern of vapor puffs resemble the pattern of dots used by a dot matrix printer to print messages on paper. The invention includes the use of multiple computational devices to enable the coordination, control and printing of aerial messages. A main or master computational device is connected, via a physical or wireless network connection, to multiple control boxes (also computational devices) located in each aircraft. Each control box is connected to a vapor or smoke system installed in its respective aircraft, which allows the control boxes to control the emission of vapor puffs from the aircraft. Software running on the master computational device is used to coordinate the vapor puffs by sending data to and receiving data from each of the control boxes.

Several benefits are obtained by the present systems and methods. For example, real-time bi-directional communication between the master computational device and each of the control boxes allow the user of the computational device to better coordinate and control the creation of the aerial message. Thus, the user of the master computational device is informed when one of the aircraft has veered out of formation and is no longer receiving data, thereby either producing misaligned vapor puffs or no vapor puffs at all. Additionally, because it is beneficial for the master pilot to know which aircraft are running low on vapor material in order to coordinate the switching of aircraft to different positions in the flight formation (allowing the aircraft with the most vapor material to be moved to positions requiring the most vapor puffs), the systems and methods provide a direct means for informing the master pilot of the vapor material levels in each slave aircraft.

Additional benefits are obtained in that the systems and methods provide an intuitive graphical user interface for easily and quickly creating multiple aerial messages, allowing a user of the master computational device to dynamically alter the aerial message and/or the message parameters (for example, message speed, width of each character, etc.) during flight. In addition, maintenance and repair of the control boxes is facilitated by the solid state design of the control boxes. The control boxes may also be easily interchanged between aircraft with minimum alteration.

A system for creating aerial messages using a plurality of aircraft. The system includes a logic and processing unit configured to provide a user interface for creating aerial messages using a plurality of aircraft, wherein the logic and processing unit is located in a master aircraft and sends data to and receives data from a master controller, and a master controller located in the master aircraft, wherein the master controller is a node on a wireless local area network (LAN) and is configured to transmit data over the LAN to a plurality of slave controllers and to receive data from each of the plurality of slave controllers. The system further includes a plurality of slave controllers located in a plurality of slave aircraft, wherein each of the plurality of slave controllers is a node on the wireless LAN and is configured to receive data from and transmit data to the master controller, and a plurality of vapor puff creation systems located in the master aircraft and in each slave aircraft.

A method for producing aerial messages. The method comprises transmitting puff data from a computer to a plurality of controllers located in a plurality of aircraft, the puff data including an indication of when each of the plurality of aircraft is to emit a vapor puff, and receiving status data at the computer from each of the plurality of controllers, the status data indicating whether the vapor puff was emitted by each of the plurality of aircraft.

A method for producing aerial message using a plurality of aircraft. The method comprises analyzing an aerial message to determine which of a plurality of aircraft should produce a vapor puff in order to form a portion of the aerial message, and transmitting data packets addressed to a controller located in each of the plurality of aircraft instructing when the aircraft should emit vapor puffs, wherein each of the data packets is transmitted over a wireless LAN to the controller.

A system for producing aerial messages using a plurality of aircraft. The system comprises a main computer configured to provide a user interface for use in producing aerial messages using a plurality of aircraft, wherein the main computer operates as a node on a wireless network to transmit data to and receive data from a plurality of controllers located in a plurality of aircraft, a plurality of controllers located in a plurality of aircraft, wherein each of the plurality of controllers is a node on the wireless network and wherein each of the plurality of controllers is configured to process data received from the main computer. The system further comprises a plurality of vapor puff creation systems located each of the plurality of aircraft.

A control box for controlling the emission of vapor material from an aircraft. The control box comprises a transceiver for transmitting data to and receiving data from one or more nodes on a wireless network, the received data including an indication of when an aircraft is to produce a vapor emission, and an antenna connected to the transceiver for use in transmitting and receiving the data from the one or more nodes on the wireless network. The control box further comprises a processor for processing the data received by the transceiver, the processor including firmware for determining from the received data when the aircraft is to produce the vapor emission, a first relay capable of activating a vapor pump in response to a signal from the processor, and a second relay for opening a solenoid valve in response to a signal from the processor.

A system for creating aerial messages. The system comprises a graphical user interface configured to display one or more screens, wherein a user employs the displayed screens to create an aerial message, a calculation module configured to calculate a number of vapor puffs required by one or more aircraft in creating the aerial message, and a database configured to store the aerial message. The system further comprises a data packet generation module configured to generate data packets including portions of the aerial message, and a simulation module configured to graphically simulate the creation of the aerial message.

A data format stored in a computer readable medium. The data format comprises a puff data portion including an indication of whether the particular aircraft is to produce a vapor puff, a duration measurement portion including a measurement for how wide to make the vapor puff, and a time delay measurement portion including a measurement for how long to wait before creating the vapor puff.

A data format stored in a computer readable medium. The data format comprises an internet protocol (IP) address portion including an address associated with a particular node on a wireless network, a vapor level data indicator portion including an indicator that data pertaining to a measurement of vapor material remaining in a tank of a particular aircraft is being sent in a data packet, and a vapor level data portion including the measurement of how much vapor material remains in the tank of the particular aircraft.

A method for simulating the creation of an aerial message. The method comprises providing a plurality of physical aircraft, providing a plurality of graphical images representative of the physical aircraft, and correlating each of the plurality of graphical images to one of the plurality of physical aircraft, wherein each of the plurality of graphical images display a vapor puff graphic at the same time as its corresponding physical aircraft emits a vapor puff.

A method of composing an aerial message. The method comprises displaying a first screen containing one or more characters of an aerial message, wherein a user selects one or more characters to compose the aerial message, and in response to the user specifying an option to save the composed aerial message, creating an aerial message file, wherein the aerial message file includes a binary representation of the composed aerial message.

A method of creating an aerial message file using a plurality of aircraft. The method comprises receiving an aerial message from a user, wherein the received aerial message includes one or more potions and wherein the received aerial message is used to create an aerial message file, and opening an output file. The method further comprises for each portion of the aerial message, scanning one or more data files for data corresponding to the portion, wherein the corresponding data is copied to the open output file; for each aircraft, calculating a number of vapor puffs required by the aircraft to produce the aerial message, wherein the number of vapor puffs required is copied to the open output file; and closing the output file, wherein the output file is the aerial message file.

A method for repositioning aircraft in a formation of multiple aircraft. The method comprises providing a network address to each of a plurality of aircraft, wherein the network address uniquely identifies each of the plurality of aircraft on a network, and providing an identifier specifying a position of each of the plurality of aircraft in a flight formation. The method further comprises, in response to a user selecting an option from a main computer to switch the positions of two or more of the plurality of aircraft, redirecting data packets to the two or more of the plurality of aircraft based on a new position of the two or more aircraft in the flight formation, wherein the data packets are redirected without requiring pilots of the two or more of the plurality of aircraft to alter any settings in the two or more of the plurality of aircraft.

A method of forming characters for an aerial message. The method comprises providing an option for a user to specify a pattern of vapor puffs, wherein the specified pattern of vapor puffs forms a desired character, receiving the pattern of vapor puffs specified by the user, and translating the received pattern of vapor puffs to a binary representation of the desired character.

A method for displaying images on a vapor screen. The method comprises determining a predefined area for an aerial vapor screen, and using software for controlling vapor emissions from a plurality of aircraft, creating an aerial vapor screen. The method further comprises projecting images onto the aerial vapor screen.

A system for composing and displaying aerial messages. The system comprises a first software module configured to permit a user of the software to compose an aerial message, and a second software module configured to coordinate the display of the aerial message.

A method for producing aerial messages. The method comprises transmitting data from a first processing unit to a plurality of controllers located in a plurality of aircraft, wherein the plurality of controllers each include a second processing unit, and receiving data at the first processing unit from each of the plurality of controllers, the received data being responsive to the data transmitted by the first processing unit.

BRIEF DESCRIPTION OF THE DRAWINGS

These and other features of the invention will now be described with reference to the drawings. These drawings and the associated description are provided to illustrate preferred embodiments of the invention, and not to limit the scope of the invention.

Throughout the drawings, reference numbers are re-used to indicate correspondence between referenced elements. In addition, the first digit of each three-digit reference number and the first two digits of each four-digit reference number indicate the figure in which the element first appears.

DETAILED DESCRIPTION

Figure 1A:
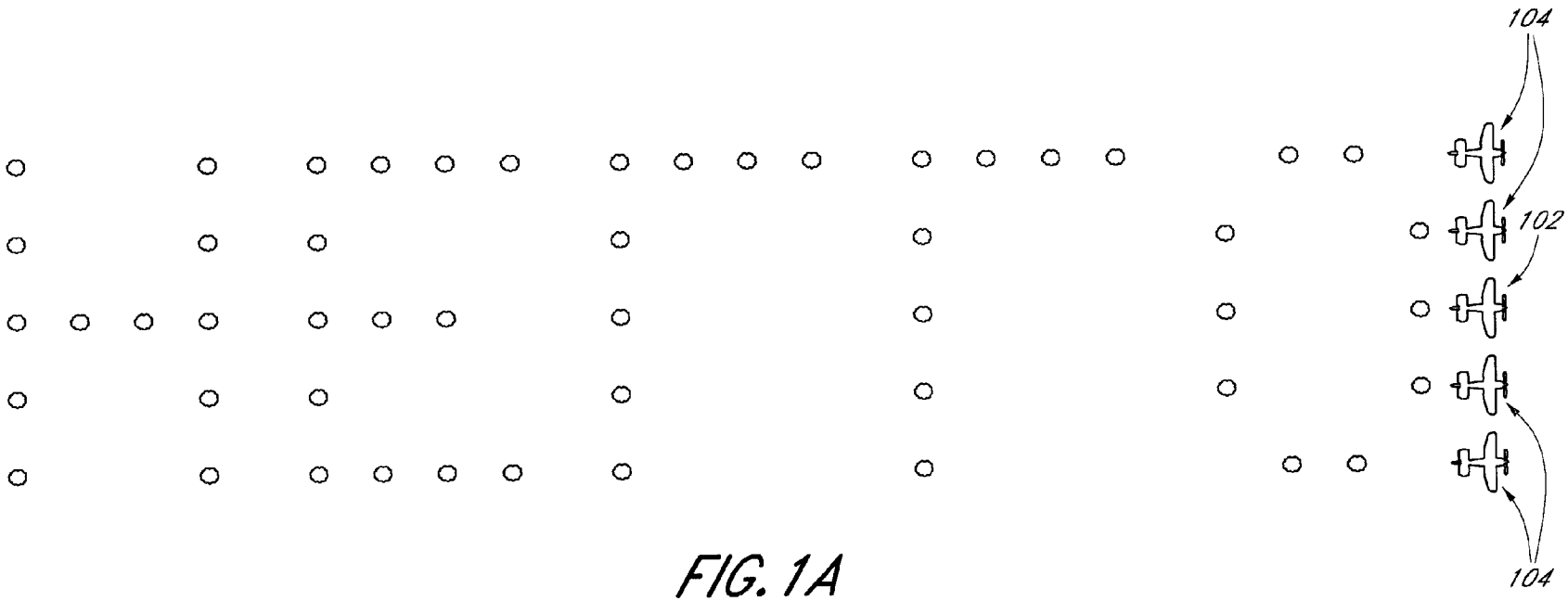
FIG. 1A illustrates a perspective view, as seen from an elevation above an aircraft formation looking down, of multiple aircraft typing an aerial message according to one embodiment of the invention.

Systems and methods representing several embodiments and an example application of the invention will now be described with reference to the drawings. In one disclosed embodiment, the systems and methods provide for the creation of an aerial message using multiple aircraft, where each aircraft emits discrete puffs of vapor or smoke to form individual characters of the aerial message, much like the discrete ink dots used by a dot matrix printer to print characters on paper. The aerial message may include, for example, but is not limited to, text messages, alphanumeric messages, Internet addresses, graphical images, symbols, and/or logos. For convenience only, and not by way of limitation, an aerial message may also be referred to herein as a skyboard.

The systems and methods may be implemented in a variety of embodiments. In one embodiment, the aerial message is "printed" using a plurality of aircraft piloted by on-board human operators. The aerial message may be printed in any orientation, include, for example, forward and backwards printing (for example, printing the aerial message "Hello" beginning either with the "H" or the "O"). Generally, one of the aircraft is designated as a master or lead aircraft and the remaining aircraft are called slave or non-lead aircraft. The master aircraft generally flies in the center position of the aircraft formation. However, the master aircraft may alternatively be located in any other position in the aircraft formation. In another embodiment, remote controlled devices, such as special-purpose remote controlled planes or drones, may be used to create (or print) the aerial message. The remote controlled devices may be commanded or piloted from a ground control station. In other embodiments, a combination of human operated aircraft and remote controlled aircraft may be used to print the aerial messages. In this dual embodiment, the master aircraft may be piloted by a human operator with the slave aircraft being remotely controlled from the master aircraft or from a ground control station.

Aerial message may be created during the daylight hours or at nighttime. In the embodiment in which messages are created after sundown, spotlights or other lighting systems are used to illuminate the aerial messages, allowing viewers from the ground to see the night aerial messages.

It will be recognized that many of the various process steps described herein are performed by or using software executed by one or more general-purpose computers, although the process steps could alternatively be embodied in-whole or in-part within special purpose hardware or firmware.

These and other features will now be described with reference to the drawings summarized above. The drawings and the associated descriptions are provided to illustrate embodiments of the invention, including various implementation-specific details of these embodiments, and not to limit the scope of the invention. The scope of the invention is set forth in the appended claims.

I. Overview

FIG. 1A illustrates a perspective view, as seen from an elevation above an aircraft formation looking down (meaning looking toward the ground), of the aircraft printing an aerial message according to one embodiment of the invention. Although depicted in a line abreast formation in FIG. 1A, the aircraft may be flown in any other appropriate flight formation, such as, for example, an echelon formation, a V formation, or a wedge formation. An echelon formation exists where the aircraft fly in standard swept back position from a front or lead aircraft. The following depicts an echelon formation, as seen from an altitude above the aircraft, with a front aircraft on the right of the formation:

```
                    X
                X
            X
        X
    X
```

The front aircraft may be on the left or the right of the flight formation. A V formation uses a front aircraft in the center of the formation with the remaining aircraft swept back from the front aircraft. The following depicts a V formation, as seen from an altitude above the aircraft:

```
            X
        X       X
    X           X
```

The wedge formation is a modified V formation using two aircraft at the front of the formation with the remaining aircraft swept back behind the two front aircraft (rather than the traditional one front aircraft involved in a V formation). The following depicts a wedge formation, as seen from an altitude above the aircraft:

```
            X       X
        X           X
    X               X
```

Figure 1B:
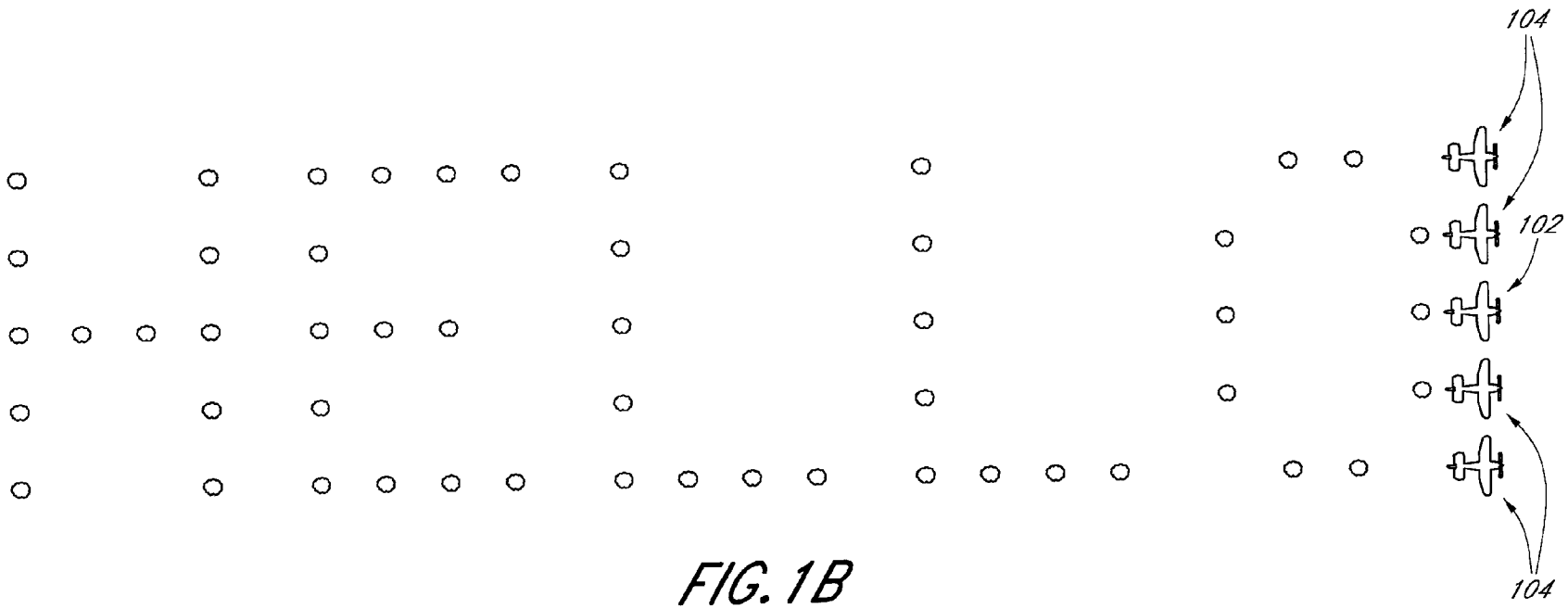
FIG. 1B illustrates a perspective view, as seen from the ground, of the aircraft typing the same aerial message according to one embodiment of the invention.

FIG. 1B illustrates a perspective view, as seen from the ground, of the aircraft printing the same aerial message as illustrated in FIG. 1A according to one embodiment of the invention. For convenience only, the view of the aerial messages as depicted in FIG. 1B will be referred to throughout this document as a "ground view," whereas the view of FIG. 1A will be referred to as an "aerial view." The aerial view of FIG. 1A is the view most commonly used by pilots in visualizing aerial messages.

In other embodiments (not shown), the aircraft fly in a vertically descending echelon formation, printing the aerial message vertically at a much lower altitude than possible with horizontal aerial messages. In this embodiment, the aircraft are arranged in an echelon formation; however, each particular aircraft flies at a lower altitude (or different altitude) than the aircraft located in front of them in the formation. Thus, the aircraft are vertically stepped down, much like the steps of a staircase. Using the vertical format, aerial messages are printed at an altitude much closer to viewers located on the ground (for example, 2,000–3,000 feet), creating impressive, spectacular aerial messages. Alternatively, a vertically descending frontline formation may be used to create the aerial messages.

The present invention employs multiple computational devices (also known as processing and logic units) to enable the coordination, control and printing of aerial messages. In one embodiment, the master aircraft 102 employs a computational device for controlling the emission of vapor puffs by all of the aircraft. The computational device may be a laptop computer, palm device, personal digital assistant, or other such appropriate device. For convenience only, and not by way of limitation, the computational device will be referred to herein as the master computer. Using aerial message software running on the master computer located in the master aircraft, the pilot of the master aircraft may dynamically edit the message, alter message parameters, and/or modify aircraft and system settings. The pilot or other user of the aerial message software may interact with the software via voice recognition methods, a touch screen, a mouse device, keyboard and/or other such appropriate interface devices.

The master computer is connected, via a network connection, such as, for example, an Ethernet connection, to a master or main control box located in the master aircraft. In other embodiments, the master computer communicates with the master control box via a wireless network connection. The master computer also communicates, via the master control box, with slave control boxes located in each of the slave aircraft 104. Each of the control boxes (master and slave) is connected to a vapor or smoke system installed in the aircraft, which allows the control boxes to control the emission of vapor puffs from their respective aircraft.

Alternatively, the master computer communicates with all of the control boxes (both master and slave) directly via a wireless network connection. In yet other embodiments, the communication control and vapor emissions of all of the aircraft (including the master aircraft) are controlled by a master computer located remotely from the aircraft, such as, for example, at a ground control station. In this embodiment, the control boxes of all of the aircraft (master and slave) may be identical, thereby eliminating any special functionality previously associated with the master control box. Using this embodiment, multiple ground control stations may be used to control the production of multiple aerial messages by the same fleet of aircraft. For example, the aircraft may produce an aerial message over a beach party with a ground control station located on the beach, and then fly inland to an air show to produce an aerial message with a ground control station located at the air show. In this embodiment, the aerial message software running at each ground control station connects to each aircraft (via the control boxes in each aircraft) when the aircraft are within range of the ground control station. The connection between the ground control station and the aircraft may be setup to occur manually or automatically.

Figure 2:
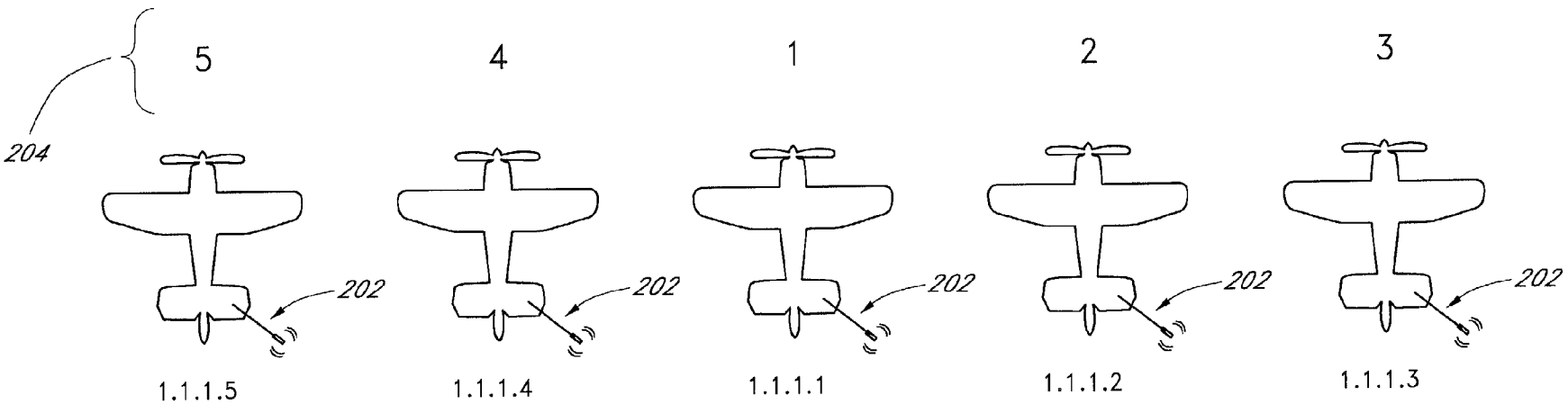
FIG. 2 illustrates the aircraft as nodes on a wireless network according to one embodiment of the invention.

FIG. 2 illustrates the aircraft represented as nodes on a wireless network according to one embodiment of the invention. The wireless network may include a local area network (LAN) or a wide area network (WAN). The aircraft communicate with the network via an antenna 202 installed on the aircraft. The antenna may be installed in any convenient location, such as on the window of the aircraft, and is connected to the control box located in the aircraft. As depicted in FIG. 2, the aircraft are arbitrarily assigned numbered formation positions 204 from left to right (as seen via an aerial view). Thus, the illustrated position ordering, from left to right is: 5,4,1,2,3, with the number 1 aircraft representing the master or lead aircraft. A unique network address is assigned to each control box (including the master control box) by the aerial message software running on the master computer. For example, as shown in FIG. 2, the master aircraft control box (also known as the master or main control box) is assigned a network address of 1.1.1.1 and is positioned in the number 1 flight formation position. The slave control box of each slave aircraft is assigned a network address corresponding to the relative numbered position of the slave aircraft in the flight formation. Thus, aircraft X is assigned a network address of 1.1.1.X. The master computer, which is also a node on the wireless network, is also assigned a network address, such as 0.0.0.6. Alternatively, any scheme may be used to assign network addresses, including, for example, a random selection scheme. Because the control box in each aircraft has a unique network address, we may herein, for convenience only, interchangeably refer to the network address as the network address of the control box or of its respective aircraft.

Although FIG. 2 shows five aircraft, the systems and methods disclosed may be applied to any number of aircraft, with each aircraft representing a node on the wireless network. Thus, for example, multiple line messages (for example, messages on two or more "lines") may be created using ten or fifteen aircraft traveling in the same or opposite direction. The ten or fifteen (or more) aircraft are organized into one fleet (which is one flight formation with one lead aircraft). Alternatively, the aircraft are divided into multiple fleets, with a lead aircraft for each fleet. In this embodiment, one or more master computers are used to control the multiple fleets. Additionally, two or more fleet of aircraft may be used to create large aerial messages. This may be particularity useful in creating large messages including graphical or logo images. In this embodiment, each aircraft fleet may, for example, fly in separate formations and may print the message in opposite directions (for example, one fleet prints a line of the message in a forward reading direction while one fleet prints a line of the message in a backward reading direction). For example, suppose a user desires to print the message "Hello World!" on two message lines, depicted as follows:

HELLO
WORLD!

Two fleets of aircraft may be used to create the lines of the aerial message at the same time, with one fleet printing "HELLO" and the second fleet printing "WORLD!" If the fleets print the message while flying in opposite directions, the first characters created may appear as follows to a viewer on the ground:

```
                    H
                                        !
```

Thus, each fleet prints a line of the aerial message at approximately the same time. The second characters being created in opposite directions would appear as follows to a viewer on the ground:

```
                    H E
                                      D !
```

The process continues until the aerial message is completed. In the alternative, one fleet of aircraft may print the message on multiple lines by either using additional aircraft in a single fleet or by turning the fleet around to print each subsequent line of the aerial message. In the embodiment in which the fleet turns around to create subsequent message lines, it may be particularly useful to alter flight formations since some of the aircraft may make the turns in less time than other aircraft in the formation. For example, if the first message line is created using a line abreast formation, the second message line may be created with an echelon formation where aircraft 3 (as shown in FIG. 2) requires the least amount of time to complete its turn but aircraft 5 requires the most time to realign in the opposite direction.

II. Aerial Message System Components

Figure 3:
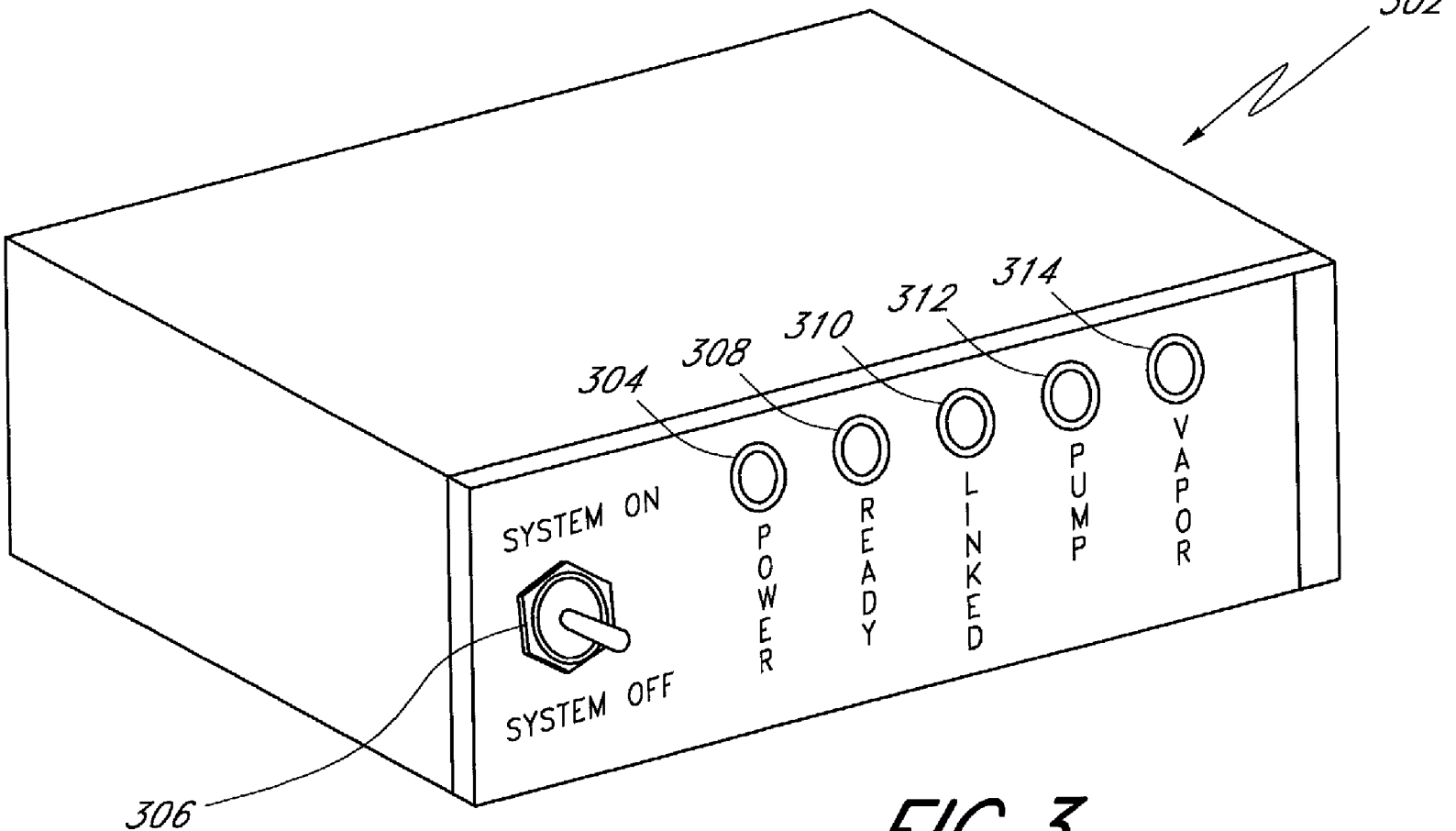
FIG. 3 illustrates a front view of a control box located in the aircraft according to one embodiment of the invention.

FIG. 3 depicts the front of a slave control box 302 located in each of the slave aircraft 104 according to one embodiment of the invention. The slave control box 302, which is a solid state system, provides a compact control unit capable of fitting into an aircraft radio rack. Multiple light emitting diodes (LEDs) on the front of the control box 302 function as status indicators for various system events. For example, the power LED 304 is activated (or lights up) when the slave control box 302 is switched on. The slave control box 302 is switched on/off using a power toggle switch 306. The ready LED 308 is activated when a connection is established between the master control box 402 and the slave control box 302, and the linked LED 310 is activated whenever the slave control box 302 is receiving packets from and/or sending packets to the master control box 402 (see FIG. 4). The pump LED 312 is activated when the pump is turned on, thereby generating vapor pressure, and the vapor LED 314 is activated whenever vapor is being emitted from the aircraft exhaust system (which occurs whenever the solenoid valve is open). Once the solenoid value is closed, the vapor LED 314 is no longer activated. The LEDs are preferably different colors (for example, red, green, orange, blue, yellow) so that a pilot may, at a glance, determine the current status of the various LED indicators. In one embodiment, the power LED and pump LED 312 are green, the linked LED 310 is yellow, the vapor LED 314 is red, and the ready LED 308 is blue.

Although not shown, the front of the master control box 402, in one embodiment, resembles the front of the slave control box 302, including each of the same LEDs. On the master control box 402, however, the linked LED indicates when the master control box 402 is receiving packets from or sending packets to the master computer 404 (see FIG. 4). In another embodiment (not shown), the control boxes employ a liquid crystal display (LCD) rather than LEDs to convey status information about various system events.

Figure 4:
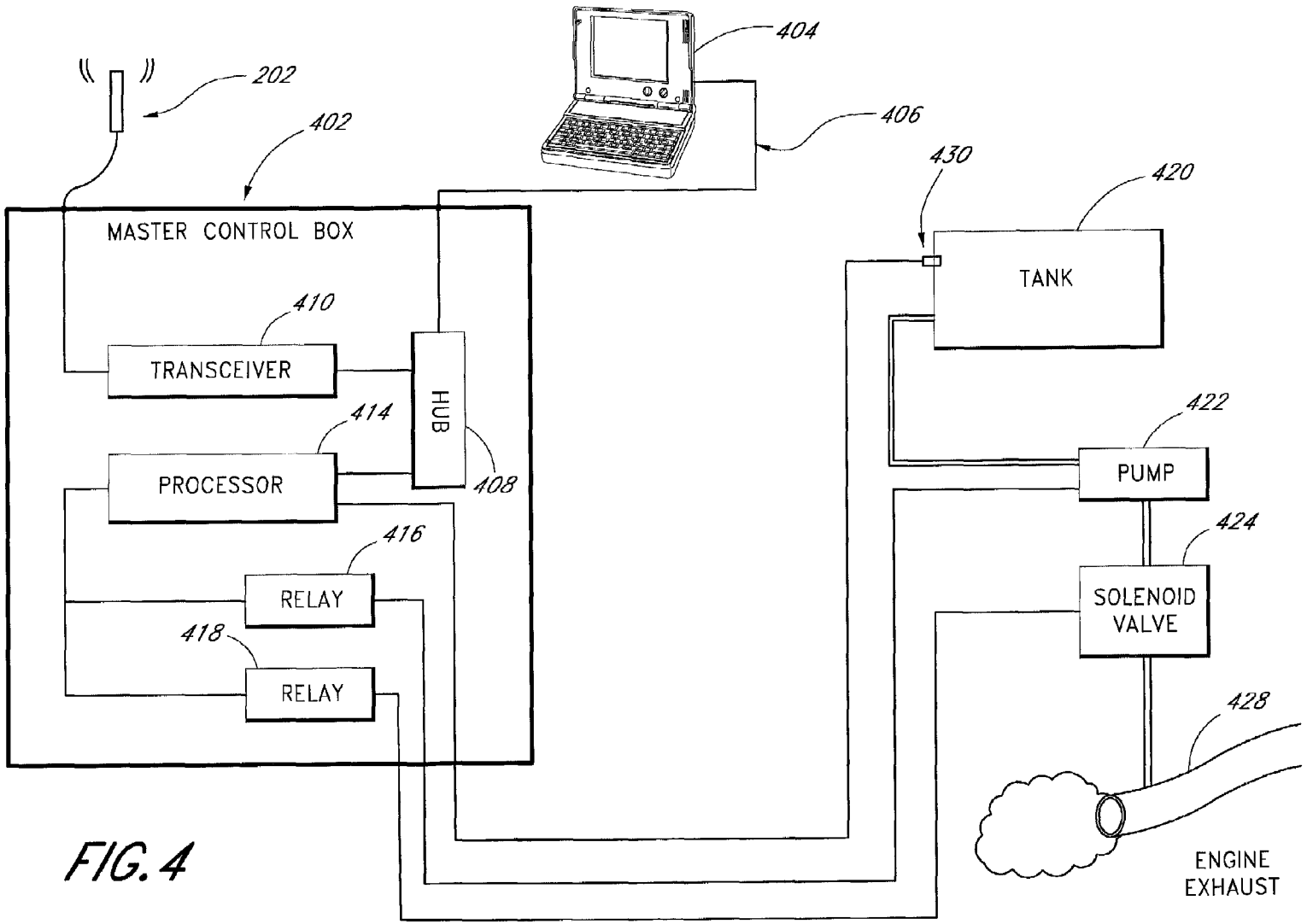
FIG. 4 illustrates a high-level block diagram of an aerial message system located in a master aircraft according to one embodiment of the invention.

FIG. 4 illustrates a high-level block diagram of an aerial message system preferably located in a master or lead aircraft 102 according to one embodiment of the invention, where the master control box 402 connects to a vapor puff creation system as shown in FIG. 4. A master computer 404 is connected to a hub 408 in a master control box 402 via a network connection 406, such as, for example, a 10/100Base-T Ethernet connection. Alternatively, any network connection may be used. The aerial message software running on the master computer 404 transmits data packets to the hub 408 via the network connection 406. The hub 408, which provides a common connection point for all devices (for example, control boxes and master computer) on the wireless network, is connected to a transceiver 410. An example transceiver that has been found to work well with the aerial message system is the Proxim 500 milliwatt Ethernet Adaptor. The transceiver 410 further divides the data packets received from the aerial message software and encrypts each portion of the data before transmitting the data portion over the network. The data packets are preferably transmitted using any FCC unlicensed bandwidth, such as the 2.4–2.48 GHz range spread spectrum technology. Although the present invention is not limited to a particular bandwidth, the system advantageously uses the 2.4 GHz band because no FCC license is required for this bandwidth. The hub forwards the data packets to the transceiver 410, which is connected to an antenna 202 in order to provide greater range in transmitting the data packets to the various nodes on the wireless network. The hub 408 is also connected to a processor 414 (microprocessor).

The processor 414, the central processing unit of the master control box 402, connects to two solid-state relays 416 and 418. Using firmware (not shown) programmed into flash read-only memory (ROM) on the processor 414, the data packets addressed to the master control box 402 are processed by the processor 414, which activates the relays 416, 418 as appropriate. The Relay 416 is connected to a pump 422. The pump 422 is also connected to a tank 420 of vapor material, such as a lightweight vegetable oil. In one embodiment, the vapor material in the tank 420 may be colored using dyes to produce colored vapor puffs (such as red, blue, green, etc.) when heated, thereby allowing for the creation of colored aerial messages. For more detail on the use of colored vapor material, please see section VII below.

When activated by the processor 414 (by, for example, a 5 volt current), relay 416 turns the pump on, thereby allowing a build up of vapor pressure to be generated in the vapor system. The tank 420 is also connected to the processor 414. A sensor 430 on the tank measures the amount of vapor material remaining in the tank and transmits such information to the processor 414. Using the program stored in flash ROM (also referred to as firmware), the processor 414 then forwards the vapor material measurements of the tank to the aerial message software running on the master computer 404. Relay 418 is connected to a solenoid value 424, which, in turn, is connected to the pump 422. When activated by the processor 414, relay 418 opens the solenoid value, allowing the vapor material to enter the aircraft engine exhaust 428. As it enters the engine exhaust 428, the vapor material is heated and emitted from the aircraft exhaust system as visible vapor or smoke. The vapor material may be introduced into the exhaust system 428 via a small hole drilled into the exhaust system (see FIG. 4), via a line running up into the opening of the exhaust system (not shown), or via a tip located approximately at the opening of the exhaust system (not shown). It should be understood by one of ordinary skill in the art, that the master or main control box may alternatively be located in any aircraft, including a non-lead aircraft.

Figure 5:
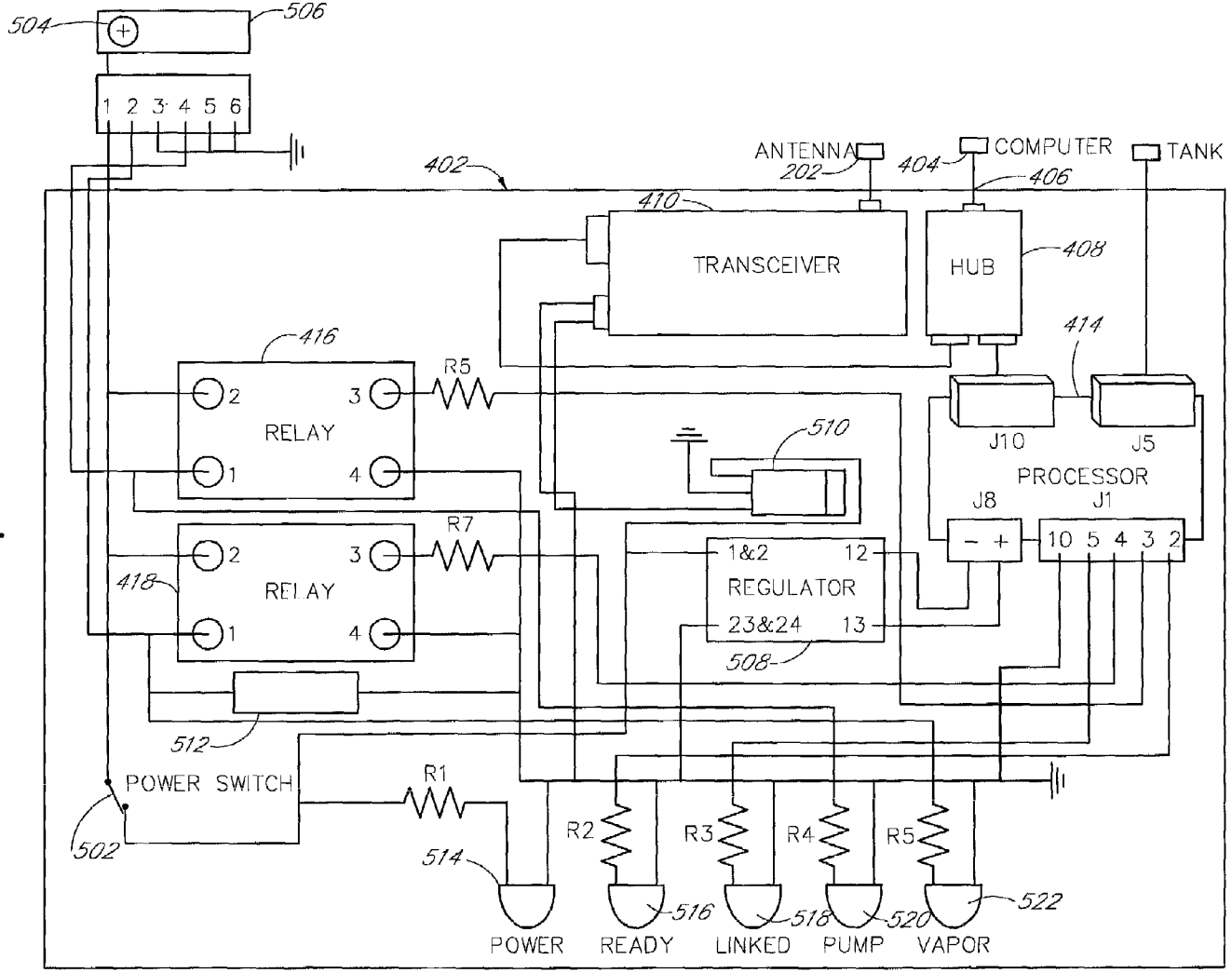
FIG. 5 illustrates a schematic drawing of an electrical circuitry of a master control box according to one embodiment of the invention.

FIG. 5 illustrates a schematic drawing of an electrical circuitry of a master control box 402 according on one embodiment of the invention. The power switch 502 is connected to a positive terminal 504 of a battery 506, which supplies an electric current to the master control box 402. While the power switch 502 is biased so as to provide the electric current to the control box 402, the power LED 514 is activated by the electric current flowing through resister R1, which in one embodiment is a 480 ohm ¼ watt resistor. The control box 402 includes a regulator 508 connected to the processor 414 and a regulator 510 connected to the transceiver 410. Regulator 508 may be any appropriate DC—DC regulator, such as, for example, a Volgen America 5 volt isolated DC—DC regulator. Regulator 510 may be any appropriate voltage regulator, such as, for example, a 12 volt or 24 volt voltage regulator.

Upon receiving an instruction from the master computer 404, via the hub 408, to switch on the electric pump 422, the processor 414 activates relay 416 (for example, through a 5 volt signal sent to the relay through resistor R6). In response, relay 416 sends a signal to activate the pump 422 (for example, using a 12 volt signal), and, at the same time, activates the pump LED 520 using a current supplied through resistor R4. After the pump 422 is switched on, the processor 414 activates relay 418 (for example, through a 5 volt signal sent to the relay through resistor R7). In response, relay 418 signals the solenoid value 424 to open by supplying an electric current to the value 424 for a specified time period, thereby allowing for the emission of vapor material through the engine exhaust 428. Relays 416, 418 may be, in one embodiment, a Philips ECG Solid State Relay. During the time in which the solenoid value 424 is open, the vapor LED 522 is activated through a current supplied through resistor R5. Relay 418 is additionally connected to a solenoid surge suppressor 512 to minimize any damage likely to be caused by transient voltages. The ready LED 516 and the linked LED 518 are activated by the processor 414 via an electric current supplied through resistors R2 and R3, respectively.

Figure 6:
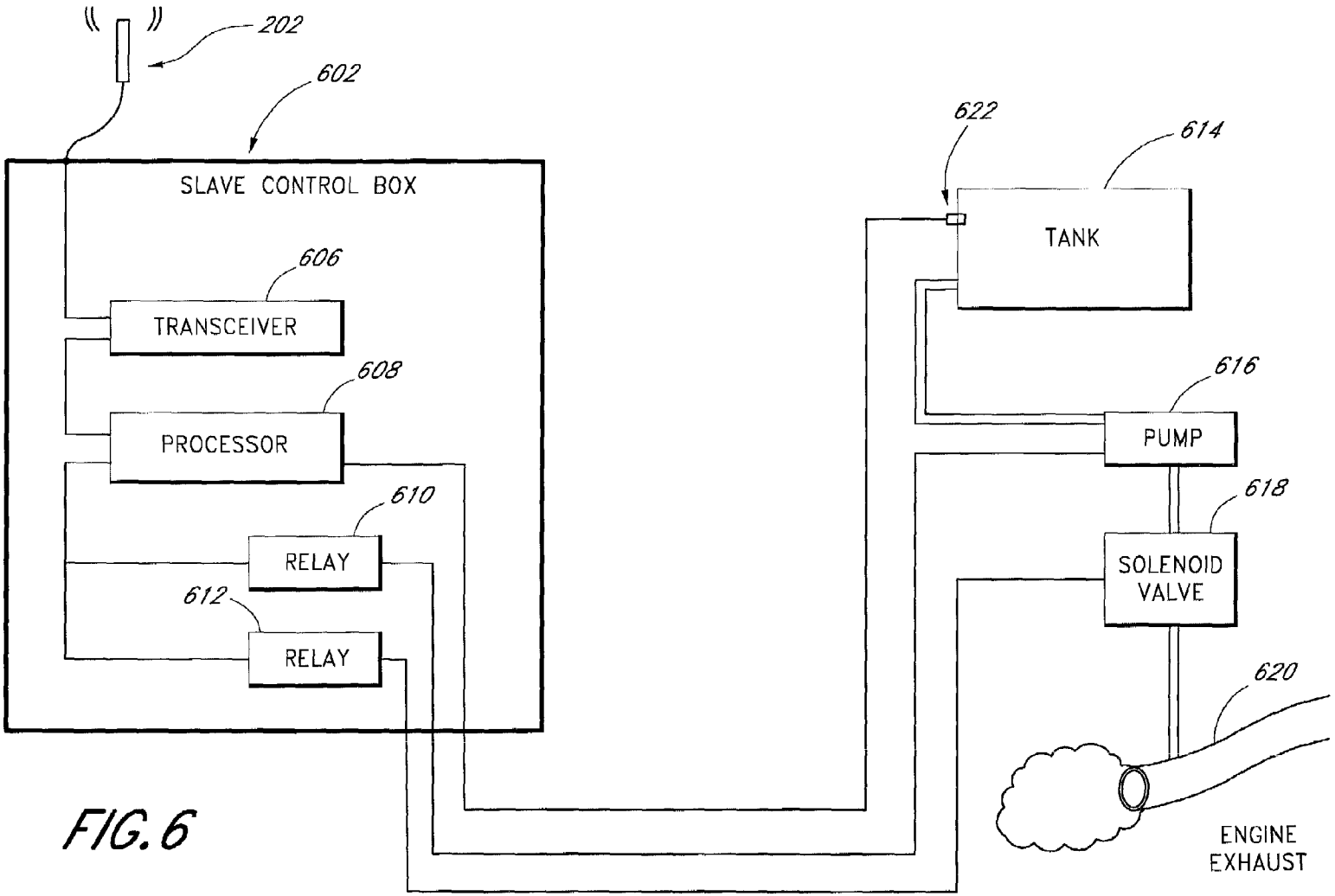
FIG. 6 illustrates a high-level block diagram of an aerial message system located in a slave aircraft according to one embodiment of the invention.

FIG. 6 illustrates a high-level block diagram of an aerial message system located in a slave aircraft 104 according to one embodiment of the invention. The slave control box 302 receives network signals across the wireless network using the antenna 202. The antenna 202 is connected to a transceiver 606, which in turn connects to a processor 608. Upon receiving network signals (all known as data packets), the transceiver 606 forwards the packets to the processor 608. As with the master control box 402, the processor 608 is connected to two relays 610 and 612. The operation of the relays 610,612, the tank 614, the pump 616, the solenoid value 618, the engine exhaust 620, and the sensor 622 function identically to the corresponding elements described above in reference to FIG. 4. For more detail on these components, please see the description associated with FIG. 4.

In another embodiment (not shown), the master computer 404 communicates directly with the control box located in each of the aircraft (including the master aircraft), rather than use a master control box 402 to transmit packets to the slave control boxes 302. In this embodiment, the control box in each aircraft, including the master or lead aircraft 102, is identical to the slave control box 302 depicted in FIG. 6. The master computer 404 may be located in a lead aircraft 102 or may be located at a ground control station. Alternatively, the master computer 404 may communicate remotely with the master control box 402 and use a repeater device in the master control box 402 to transmit data packets to the slave control boxes 302.

Figure 7:
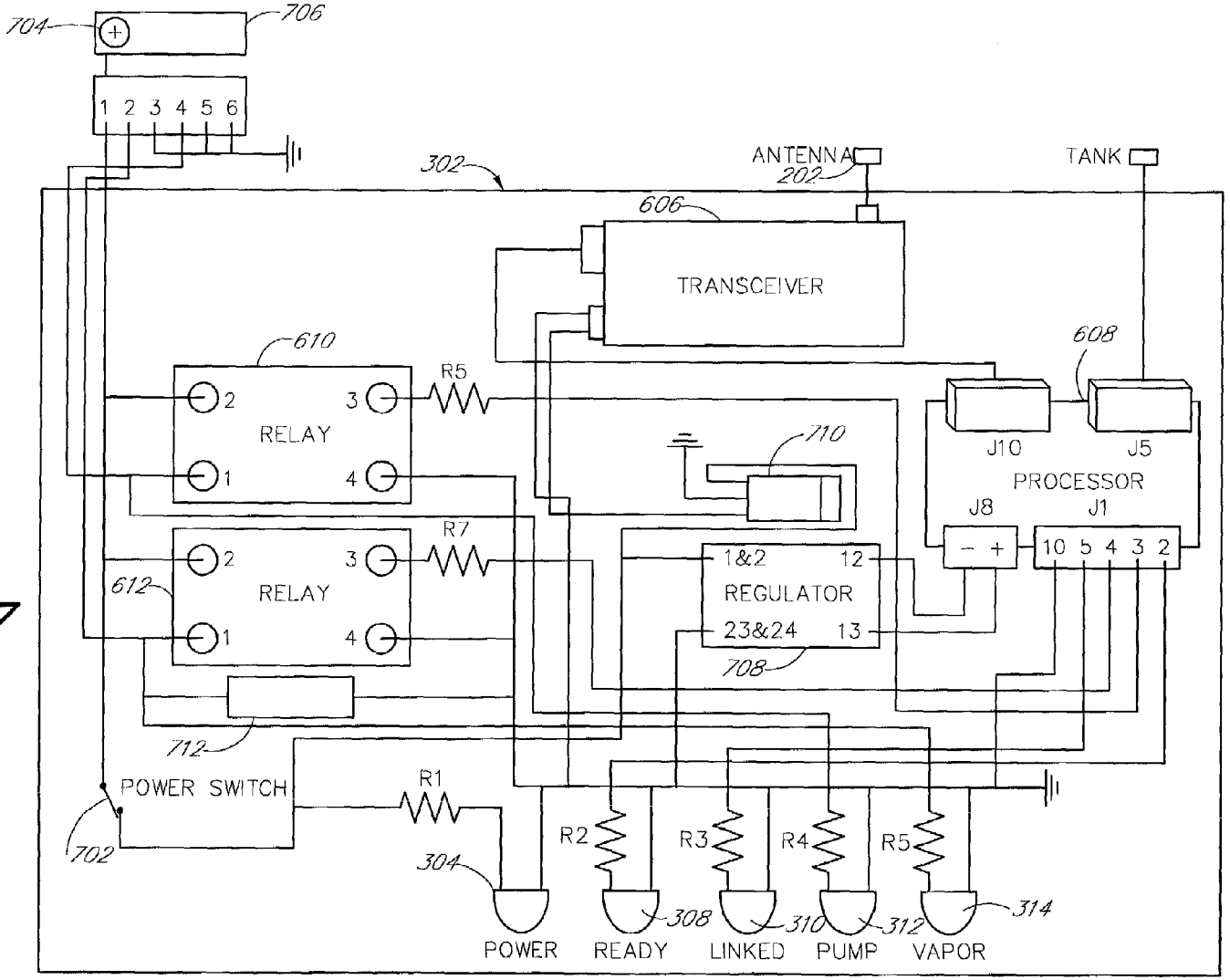
FIG. 7 illustrates a schematic drawing of an electrical circuitry of a slave control box according to one embodiment of the invention.

FIG. 7 illustrates a schematic drawing of an electrical circuitry of a slave control box 302 according to one embodiment of the invention. The shown electrical circuitry operates substantially the same as the electrical circuitry of the master control box 402, except that data is transmitted to and from the processor 414 through the transceiver 606 and antenna 202, rather than through a hub device. Please see the above description associated with FIG. 5 for additional details.

III. Aerial Message Software System

Figure 8:
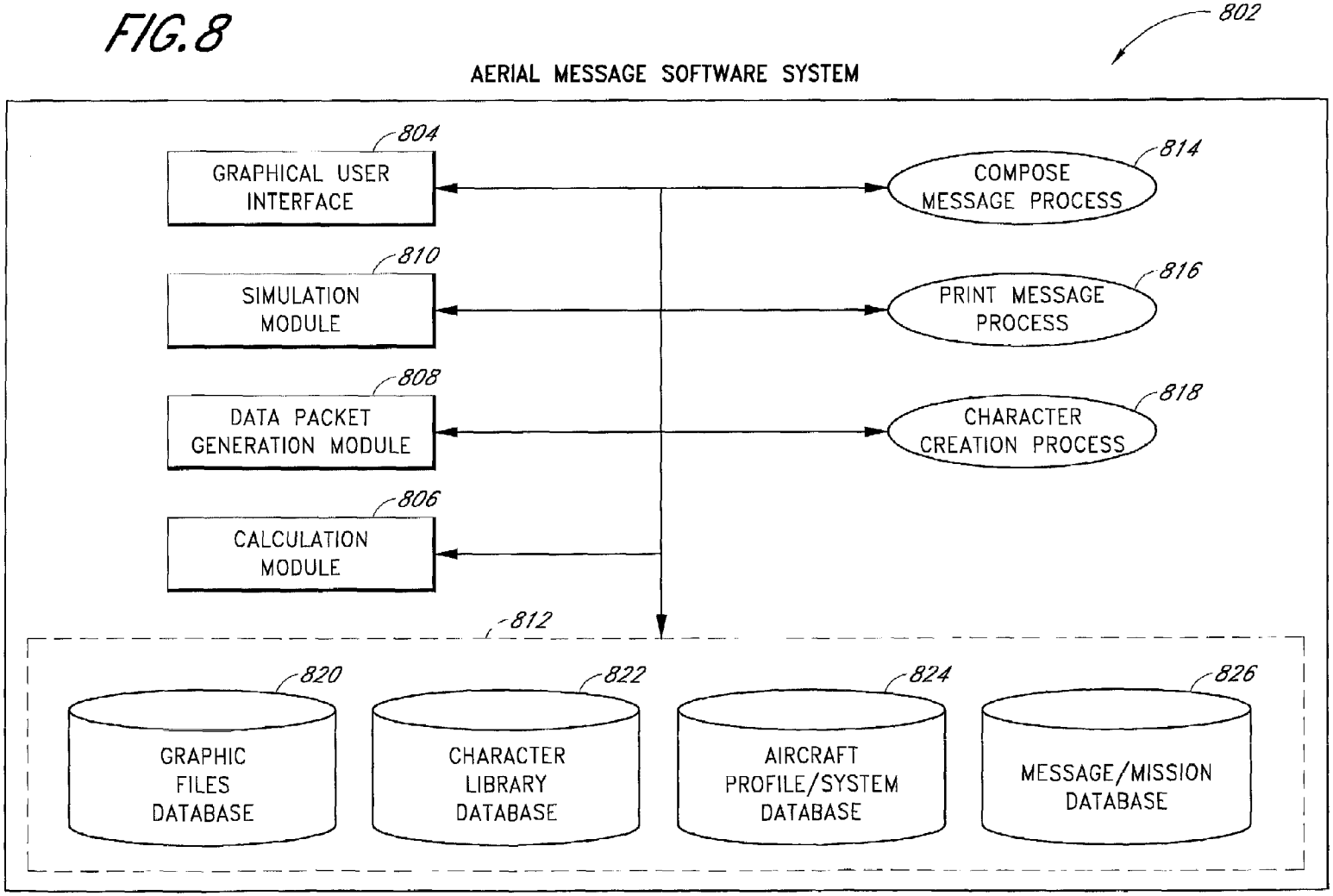
FIG. 8 illustrates a high-level block diagram of an aerial message software system according to one embodiment of the invention.

FIG. 8 depicts an aerial message software system 802 according to one embodiment of the invention. As depicted, the system 802 includes a graphical user interface 804, a calculation module 806, a data packet generation module 808, a simulation module 810, a database system 812, a compose message process 814, a print message process 816, and a character creation process 818.

As used herein, the word module refers to logic embodied in hardware or firmware, or to a collection of software instructions, possibly having entry and exit points, written in a programming language, such as, for example, C++ or Visual Basic. A software module may be compiled and linked into an executable program, or installed in a dynamic link library, or may be written in an interpretive language such as BASIC. It will be appreciated that software modules may be callable from other modules or from themselves, and/or may be invoked in response to detected events or interrupts. Software instructions may be embedded in firmware, such as an EPROM or EEPROM. It will be further appreciated that hardware modules may be comprised of connected logic units, such as gates and flip-flops, and/or may be comprised of programmable units, such as programmable gate arrays or processors. The modules described herein are preferably implemented as software modules, but may be represented in hardware or firmware.

It is contemplated that the modules may be integrated into a fewer number of modules. One module may also be separated into multiple modules. The described modules may be implemented as hardware, software, firmware or any combination thereof. Although, the modules are preferably located in the master computer 404, the described modules may alternatively reside at different locations connected through the network.

A. Graphical User Interface

The graphical user interface 804 (GUI) provides easy to use graphical screens for composing an aerial message, printing an aerial message, and creating a character library. The GUI also interacts with the simulation module 810 to provide detailed real-time feedback on the actual printing process. Additionally, the graphical user interface 804 provides access to a database system 812, including data on the number of messages printing and aircraft and system parameters. A user of the aerial message software interacts with the GUI using a mouse, touch screen, keyboard, or other such interface device.

B. Calculation Module

The calculation module 806 performs various calculation steps involved in composing and printing an aerial message, including calculating the number of puffs required by each aircraft to produce a particular aerial message and correlating data received by the aerial software from the slave control box 302 indicating the amount of vapor material remaining in each slave aircraft. The calculation module 806 converts the received data into a numerical value, which is displayed using the graphical user interface 804.

C. Data Packet Generation Module

The data packet generation module 808 generates data packets for transmission on the wireless network by gathering data from the calculation module 806 and the graphical user interface 804. Both the master control box 402 and the slave control box 302 transmit and receive data packets. Data packets are generated by the data packet generation module, which is distributed between the aerial message software and the control boxes, at intermittent times, such as, for example, every 2–3 seconds. With an average packet size of 10–12 Kb, the data packets may be transmitted frequently without slowing down the network. For more information on the sample file and data packet formats for the aerial message system, please refer to the section below entitled "Sample Data Format," which describes FIG. 9A and FIG. 9B.

D. Simulation Module

The simulation module 810 controls a simulation of the aircraft and vapor generation during printing of the aerial message, which is displayed in the simulation window 1504 (see FIG. 15) of the graphical user interface 804. By synchronizing the simulated vapor emissions in window 1504 with the actual vapor puffs created by each aircraft, the simulation module 810 provides a dynamic, real-time view of the printing of the aerial message.

E. Database System

The database system 812 includes a graphic files database 820, a character library database 822, an aircraft profile/system database 824, and a message/mission database 826. The graphic files database 820 includes a graphical image of each character. The graphical image is displayed above selectable icons on the compose message screen 1102 (see FIG. 11). In one embodiment, the graphic file is displayed from an aerial view, but may alternatively be displayed from a ground view. The character library database 822 stores information about each character in a character library file 1302 and stores multiple library files 1302 (see FIG. 13). The aircraft profile/system database 824 stores information about specific aircraft and about the aerial message system parameter, including, for example, the vapor capacity of each type of aircraft, the time delay needed for particular flight formations, and/or an out of range distance defining when slave aircraft veer out of formation. The message/mission database 826 includes data about the number of messages/missions loaded and completed (such as, for example, the mission log files).

Although the above-described databases have been discussed as individual databases, it is to be understood that the particular databases may be included in one database or may be divided into additional database. The databases, although preferably located on the master computer, may alternatively in-whole or in-part be distributed across a network.

F. Compose Message Process

The compose message process 814 creates an aerial message file 1402 (see FIG. 14) from input received from a user of the aerial message software. For a detailed description of the compose message process 814, please refer to the section entitled "Composing An Aerial Message" below.

G. Print Message Process

The print message process 816 prints an aerial message from the aerial message file 1402. For a detailed description of the print message process 816, please refer to the section entitled "Print a Message" below.

H. Character Creation Process

Figure 23:
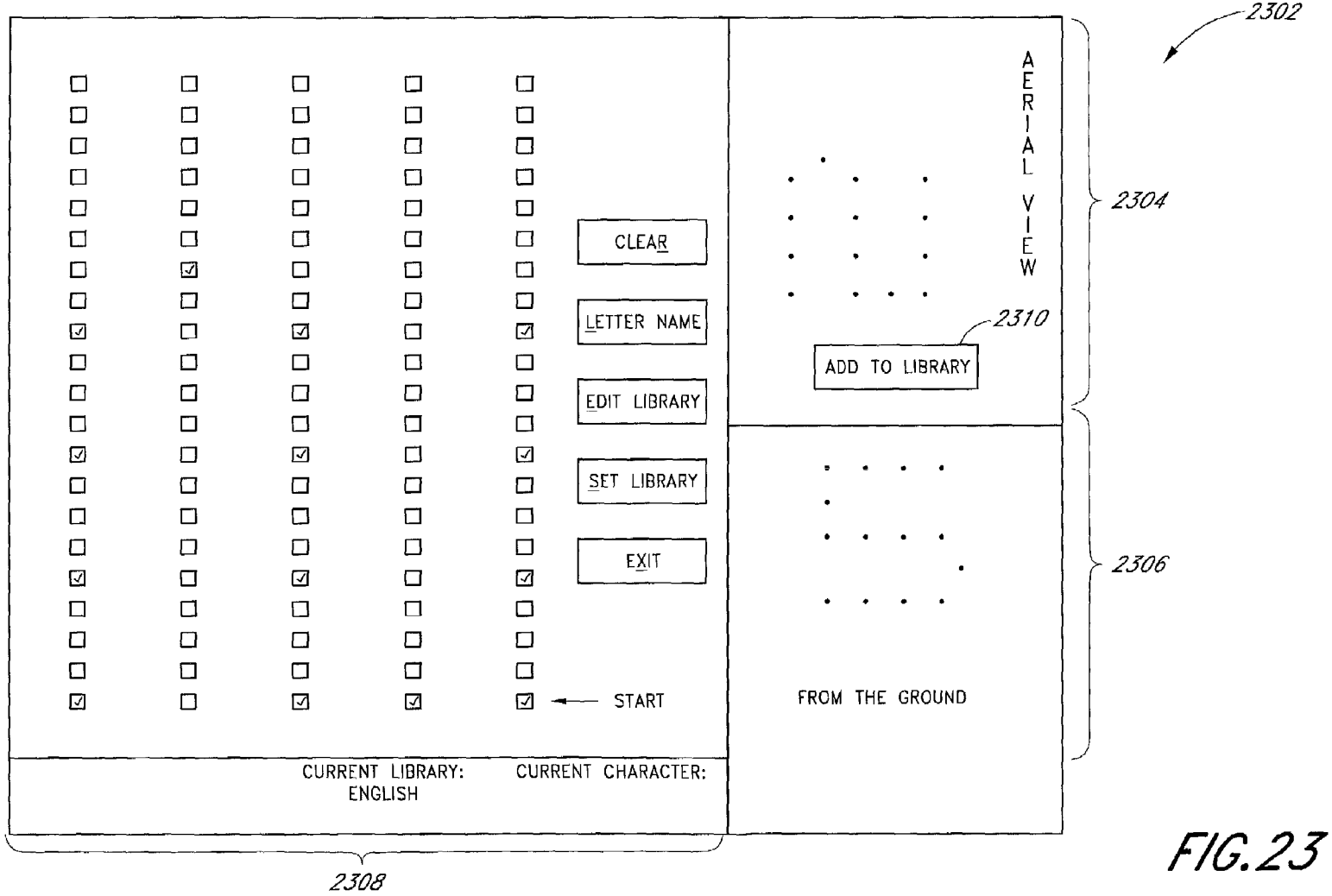
FIG. 23 illustrates an example character creation screen according to one embodiment of the invention.

The character creation process 818 creates new library character using an input grid 2308 (see FIG. 23). For a detailed description of the character creation process 818, please refer to the section entitled "Creating a Character Library" below.

IV. Sample Data Format

Figure 9A:
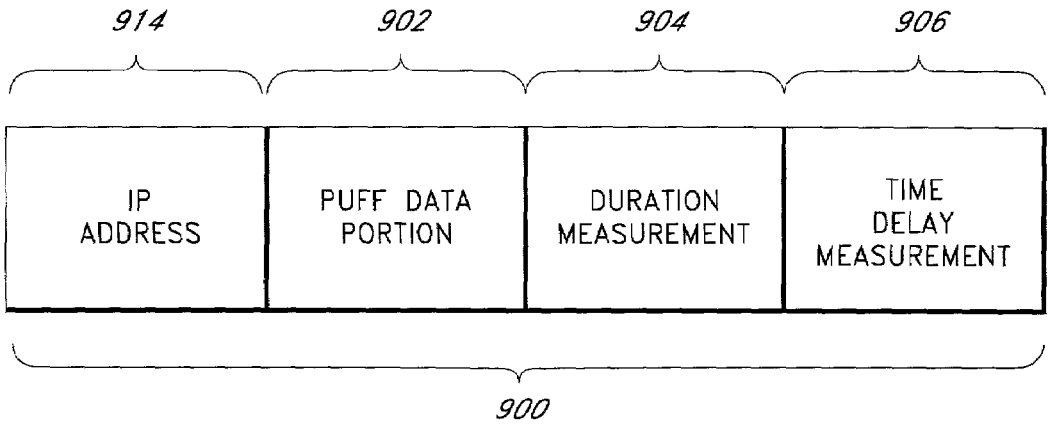
FIG. 9A illustrates a sample data format for a puff data packet according to one embodiment of the invention.

FIG. 9A illustrates a sample data format 900 for a puff data packet according to one embodiment of the invention. Given an aerial message file 1402 (see FIG. 14), the systems and methods produce a puff data packet format 900 including an IP address 914, a puff data portion 902, a duration measurement 904, and a time delay measurement 906 as indicated below:

IP ADDRESS+PUFF DATA PORTION+DURATION MEASUREMENT+TIME DELAY MEASUREMENT=PUFF DATA FORMAT.

In one embodiment, the puff data portion 902 is generated by the data packet generation module 808 according to the methods described below, and includes an indicator of whether the particular slave aircraft 104 being sent the puff data packet 900 is to produce a vapor puff. The indicator may be any indicator capable of representing a puff status and a no puff status. For example, in one embodiment, a "1" is transmitted as the puff data portion if the slave aircraft 104 is to emit a vapor puff and a "0" is transmitted as the puff data portion if the slave aircraft 104 is not to emit a vapor puff. The duration measurement 904, which may be determined substantially real-time by the calculation module 806, provides information about the width of the puff to be created by the particular slave aircraft 104. The time delay measurement 906 is also generated by the calculation module 806, and allows for a time delay between receipt of the puff data packet 900 by the slave control box 302 and generation of a vapor puff. The time delay measurement 904 is altered depending on the particular flight formation being used to create the message, and the particular position 204 of the slave aircraft 104 in the flight formation. The position 204 becomes more important in non-line abreast formations, such as with an echelon or V formation. The IP address 916 indicates where to send the data format 900.

Figure 9B:
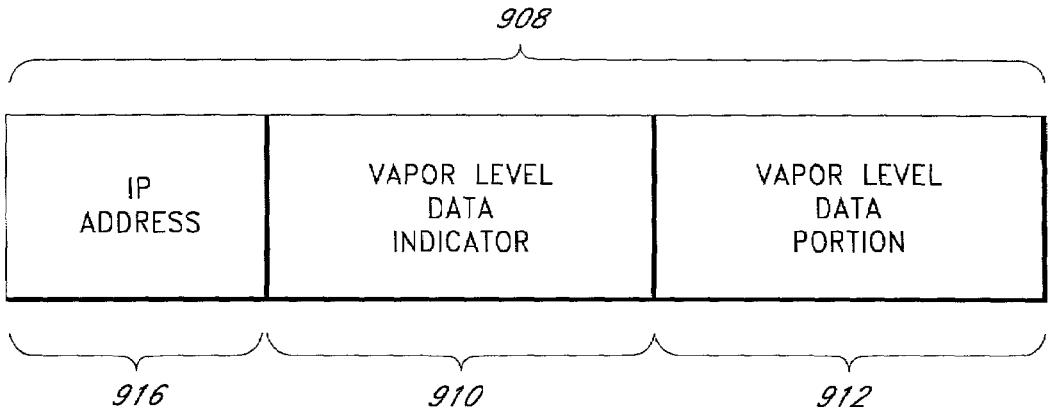
FIG. 9B illustrates a sample data format for a vapor level data packet according to one embodiment of the invention.

FIG. 9B illustrates a sample data format 908 for a vapor level data packet, generated by a slave control box 302, according to one embodiment of the invention. After the sensor measures the vapor level in a tank 420,614, the systems and methods produce a vapor level packet format 908 including an IP address 916, a vapor level data indicator 910 and a vapor level data portion 912 as indicated below:

IP ADDRESS+VAPOR LEVEL DATA INDICATOR+VAPOR LEVEL DATA PORTION=VAPOR LEVEL DATA FORMAT.

In one embodiment, the vapor level data indicator 910 is an indicator that the data packet being sent contains data about the level of vapor material in a particular slave aircraft 104. The vapor level data portion 912 contains an actual measurement value for the amount of vapor material remaining in the tank of the slave aircraft. The IP address 916 indicates where to send the data format 908.

Several additional data formats are transmitted by either the master control box 402 or the slave control box 302. In addition to the puff data format, the master control box 402 generates and sends packets to determine whether a slave aircraft is still actively on the network. If no response is received to the transmitted data packet within a specified time period, the pilot of the master aircraft 102 is notified of the non-responding slave, and the aerial message software attempts to auto-reconnect with the non-responsive slave aircraft 104. The master control box 402 may also send a data packet querying the slave control box 302 to determine the amount of vapor material remaining in the tank of the slave aircraft 104. For additional details on the process of determining the amount of vapor material remaining in each tank, please see section VII.B below. Additionally, the aerial message software running on the master computer 404 (via the hub 408) sends data packets to the control boxes 302, 402 signaling the control boxes to turn the pumps 616, 422 on and off. Thus, the aerial message software may, in one embodiment, automatically control the electric pumps 422, 616 with minimum interaction by the pilot of each aircraft. Turning the pumps 616, 422 off when not in active use printing aerial messages minimizes the risk (due to the constant pressurized vapor material in the line between the pump 422, 616 and the solenoid valve 424, 618) of a high-pressure explosion and reduces wear and tear on the parts of the pumps 616, 422.

In addition to the vapor level data format 908, the slave control box 302 also generates and sends confirmation data packets confirming that the slave control box 302 turned the pump 616 on or off and that the slave aircraft made a puff as instructed by the master control box 402. In one embodiment, the confirmation data packet transmitted back to the master control box 402 by the slave control box 302 is an echo (or a duplicate) of the message originally sent by the master control box 402. If the slave aircraft 104 is still within range, the slave control box 302 also responds to data packets from the master control box 402 querying to find out whether the slave control box 302 is active and responding on the network.

Although the discussion of this section has referred to the master control box 402 sending data packets to the slave control boxes 602, it is to be understood that the data packets are often, although not always, generated by the aerial message software running on the master computer 404. It is also understood that the master control box 402 receives and transmits the same data packets as described for the slave control boxes 602. Thus, for example, the aerial message software sends a puff data packet to the master control box 402 in order to generate a vapor puff by the master aircraft 102. Likewise, the master control box 402 generates a confirmation data pack back to the aerial message software once a vapor puff has been created.

V. Aerial Message Software Methods

By providing a flexible and user-friendly graphical user interface (GUI), the aerial message software allows a user to easily design and store a virtually unlimited number of characters, which may be readily assembled into aerial messages or skyboards using a character library. A collection of skyboards may also be assembled together to create a "mission." A mission includes multiple skyboards to be printed at various locations for one or more clients. By collating multiple skyboards into one mission, the pilot of the master aircraft need only load one file containing all of the skyboards to be created during the flight. The aerial message software automatically pauses after completion of each skyboard and waits for the user to select (for example, using a mouse, touch screen or voice recognition software) an option to print the next skyboard. Thus, the aircraft can fly between various locations printing multiple skyboards without loading additional files.

The software additionally provides a GUI from which a user may control the production of vapor puffs for all aircraft in the flight formation. By real-time accounting for aircraft speed, puff length and aircraft formation, the software allows aerial messages to be printed with almost any aircraft at almost any speed and altitude. The bi-directional communication also provides real-time data regarding the amount of vapor material remaining in each aircraft, allowing a user of the software to readily determine when to switch aircraft between different formation positions so as to maximize vapor usage and reduce the chance that one aircraft will run out of vapor material before the end of an aerial message or mission.

A. Composing An Aerial Message

A user composes an aerial message using the aerial message software running on the master computer 404. A GUI and related software methods involved in composing an aerial message will now be described with reference to FIGS. 10–14.

1. Graphical User Interface

Figure 10:
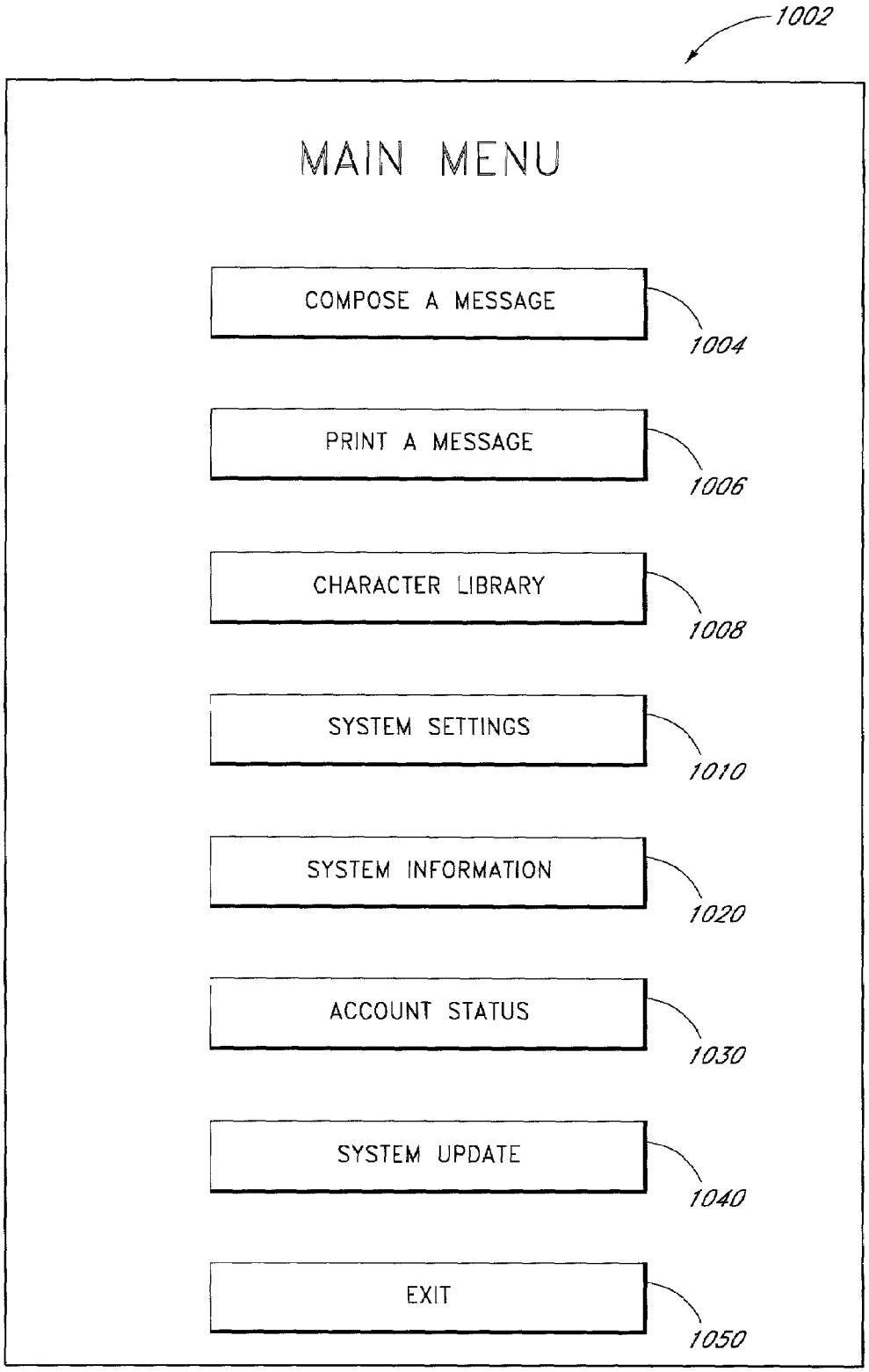
FIG. 10 illustrates an example main menu screen according to one embodiment of the invention.
Figure 11:
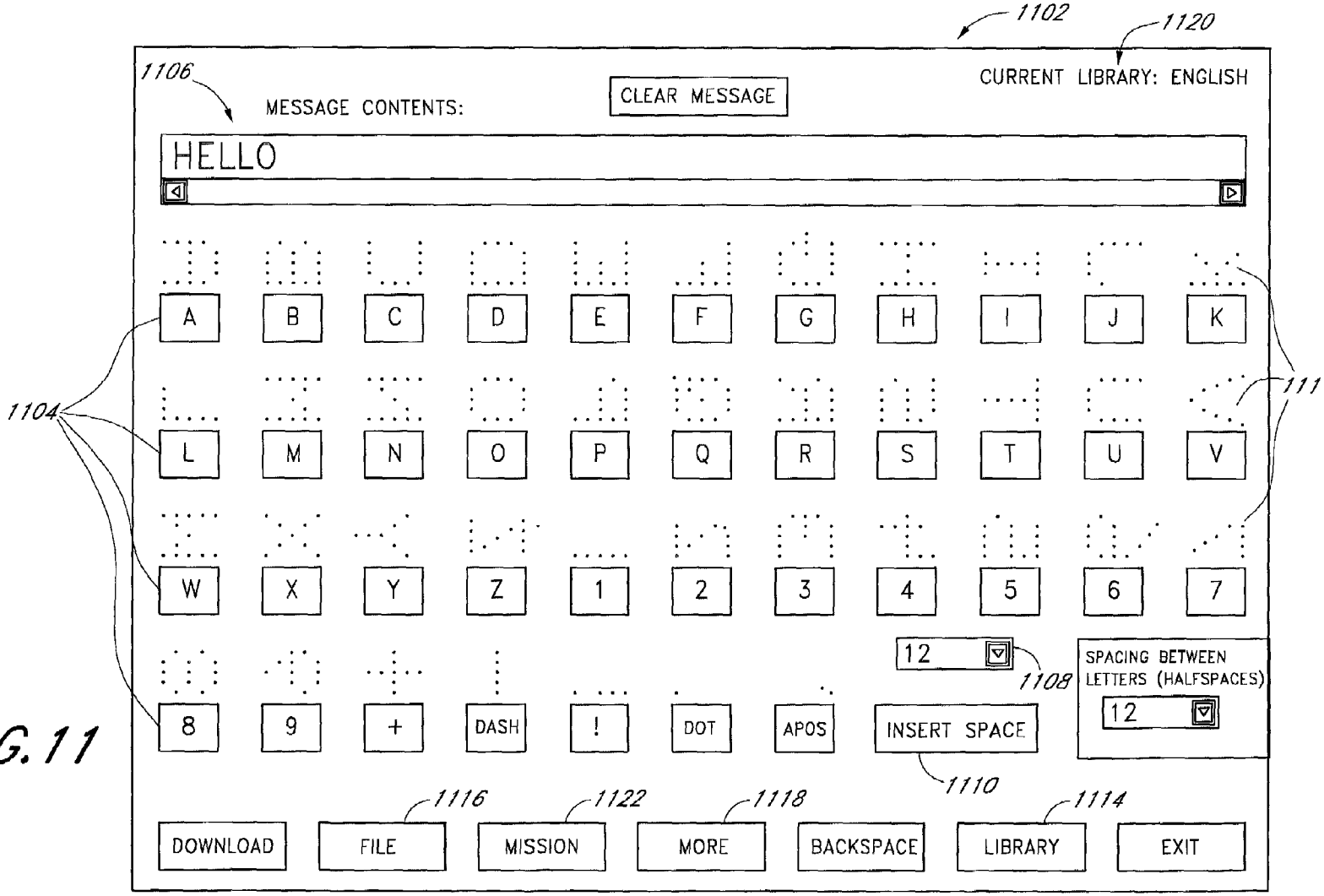
FIG. 11 illustrates an example compose message screen according to one embodiment of the invention.

FIG. 10 illustrates an example main menu screen 1002 for the aerial message software according to one embodiment of the invention. To compose a message using an already existing character library (see discussion in section C below for creating a new character library), the user selects an option 1004 from the main menu screen 1002 to compose an aerial message. Upon selecting option 1004, a compose message screen 1102 with a default library, such as English already loaded, is presented to the user. FIG. 11 illustrates an example compose message screen 1102 according to one embodiment of the invention, with the default library 1120 being English. As depicted in FIG. 11, the compose message screen 1102 displays selectable icons 1104 with each character graphically represented on the icons 1104. Additionally, the aerial view orientation (the orientation from above the aircraft looking down) of each character 1112 is displayed above its respective icon 1104.

A character may be any letter, number, punctuation mark, accent mark, symbol, graphic, image, picture or other mark normally used in printed communication. By selecting each character (for example, via clicking a button, pushing a key, speaking a sound, etc.), the user enters an aerial message into the message window 1106. The user alters the spacing between characters by selecting or otherwise entering a number into the font spacing box 1108 and selecting an option 1110 to insert a space. The spacing may be altered between characters on a character-by-character basis to create messages having more or less spaces between various characters or portions of the aerial message. In one embodiment, a default spacing of 12 is inserted between each character unless the user alters the spacing. For more detailed information on the spacing between characters, please see section V.A.2, entitled "Composing Methods," below. As illustrated by the compose message screen 1102, the standard English library may include additional symbol or marks, such as dashes, dots, exclamation points or apostrophes.

The user may also load different character libraries by selecting an option 1114 to change the current library. In response to selection of the change library option 1114, a pop-up screen (not shown) is displayed listed all currently defined libraries. The defined libraries may include, for example, English, French, Spanish, Japanese and so forth. Libraries may also be created according to various themes, such as, for example, a holiday library (with holiday messages and graphics) or a natural disaster awareness library (with emergency instruction messages). The GUI and methods additionally allow the user to toggle between existing libraries when creating an aerial message, forming messages with characters from one or more languages. For example, by typing or otherwise entering an English phrase, toggling to the Spanish library and entering a Spanish phrase, and toggling back to the English library to finish the message with another English phrase, the user may create a dual language aerial messages, such as, for example, "Visit Mi Casa Mexican Restaurant!" Stylization fonts, such as italics, bold or even underlining, may also be produced using the disclosed methods for composing an aerial message. For example, to produce italics fonts, a user creates italicized characters using the character library features (see section V.C below) or alters the time delay measurement for the aircraft (see section IV above and section V.B.2 below) in order to slant the characters of the aerial message. To produce bold fonts, in one embodiment, the duration measurement (see section IV above) is altered to keep the solenoid valve 424, 618 open longer, thereby creating a denser vapor puff. After the user has completed the message, the user selects an option 1116 to name and save the file.

Missions, which are discussed above, are created by selecting an option 1122 to join multiple aerial messages into a single mission file (not shown). If a library includes more characters than possible to fit comfortably on the compose message screen 1102, the user may review all of the library characters by selecting an option 1118 to review additional library characters not displayed on the current screen.

2. Composing Methods

Figure 12:
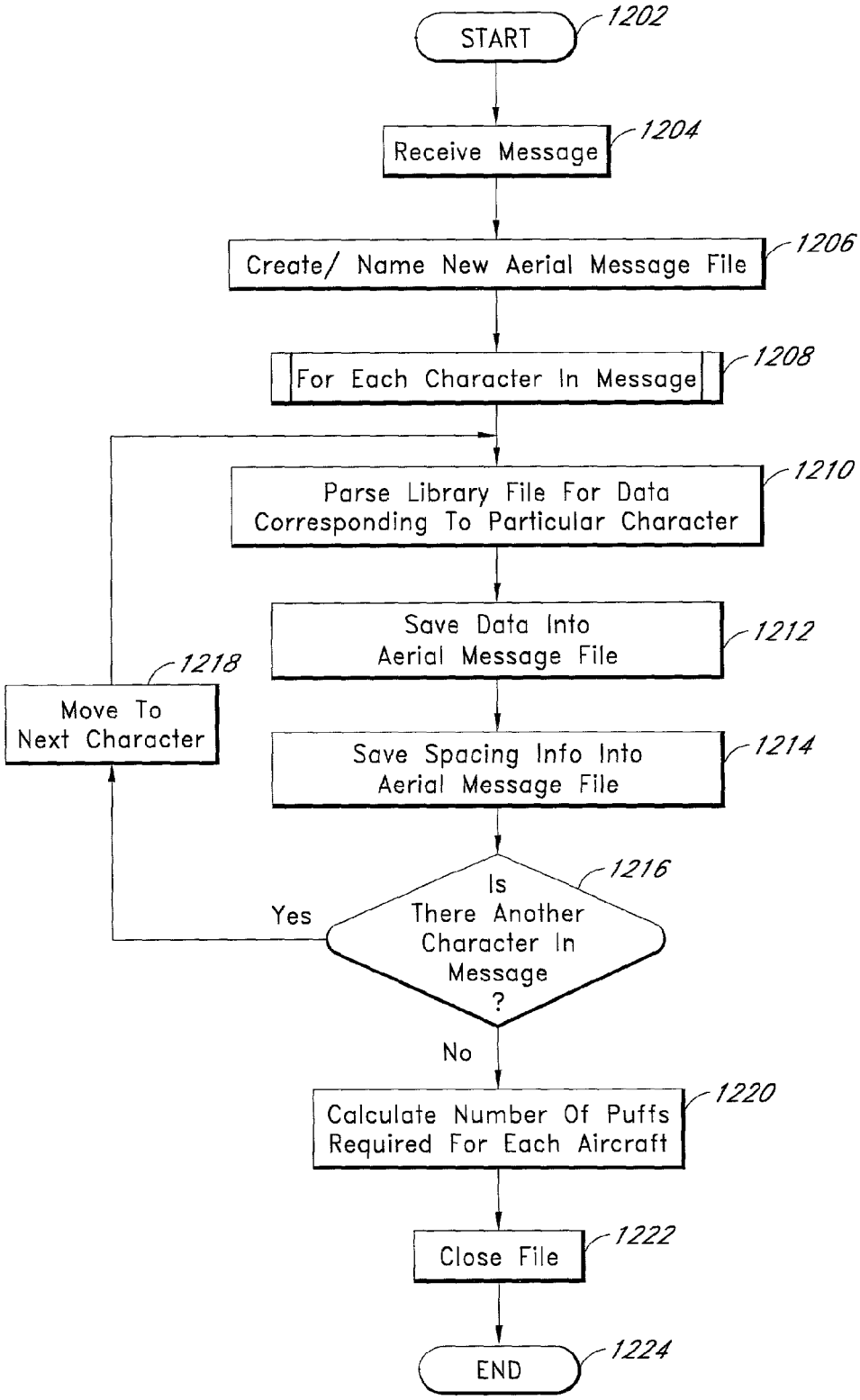
FIG. 12 illustrates a flow chart for producing an aerial message file according to one embodiment of the invention.

One embodiment of the software methods relating to composing and saving an aerial message will now be described in further detail with reference to FIG. 12. Beginning at a start state 1202, the composing process proceeds to the next state 1204, wherein an aerial message is received from the user. The aerial message received may be in the form of a temporary file. Thus, the receiving of the aerial message may refer to the receiving of a pointer to a memory address and/or physical location where the file is located. In state 1206, a new aerial message file 1402 (see FIG. 14) is opened (i.e., created) and named according with the name specified by the user.

Figure 13:
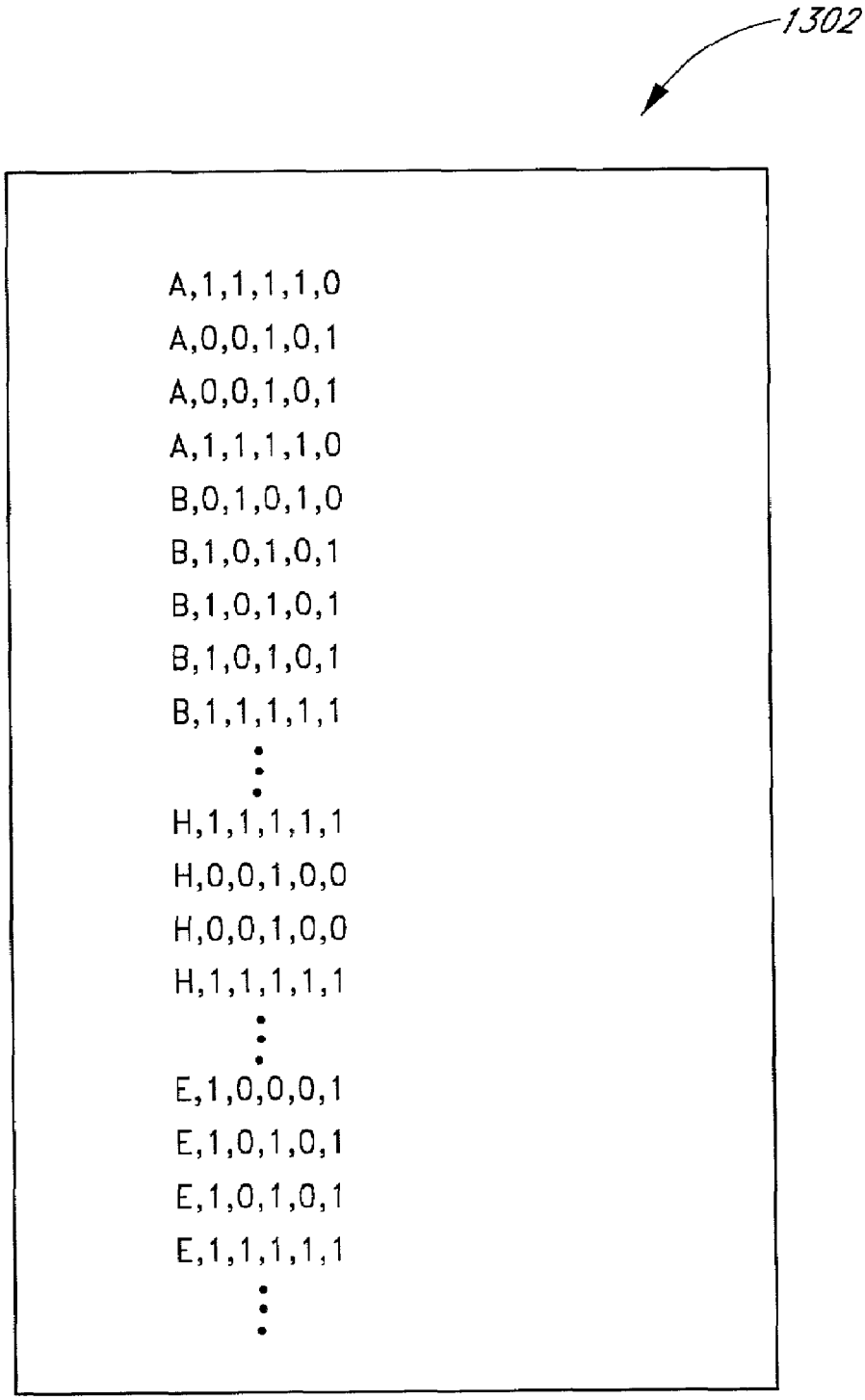
FIG. 13 illustrates a portion of an example English character library file according to one embodiment of the invention.

Beginning in state 1208 and continuing through state 1216, each character in the aerial message is analyzed to determine a corresponding vapor puff pattern for the given character. In state 1210, the appropriate library file 1302 (see FIG. 13) is parsed to extract the puff data (also called the vapor puff pattern) corresponding to the given character. FIG. 13 illustrates an example English library file according to one embodiment of the invention. The library file includes multiple lines (or rows) having a defined character followed by multiples 0's and 1's, with the 1's arranged in a pattern representative of the associated character. Thus, for example, if the character L is to be represented with 1's forming an L pattern, the pattern, from the ground, would look as follows:

| | | | |
|---|---|---|---|
| 1 | | | |
| 1 | | | |
| 1 | | | |
| 1 | | | |
| 1 | 1 | 1 | 1 |

Pilots generally view characters along a flight line or path used in creating the characters, which is referred to herein as an aerial view. The aerial view of the same L character is achieved by taking the mirror image of the ground view and rotating the image 90° counterclockwise. For example, the mirror image of the above shown L character is shown as follows:

| | | | |
|---|---|---|---|
| 1 | 1 | 1 | 1 |
| 1 | | | |
| 1 | | | |
| 1 | | | |
| 1 | | | |

Next, to visualize the aerial view, the above shown mirror image is rotated 90° counterclockwise, which produces the following aerial view of the L character:

| | | | | |
|---|---|---|---|---|
| 1 | | | | |
| 1 | | | | |
| 1 | | | | |
| 1 | 1 | 1 | 1 | 1 |

In this example, the required vapor puff pattern corresponds to the pattern of 1's seen above. Filling the empty positions in with 0's to represent the condition where no vapor puff is to be generated and separating the puff/no puff data with commas to allow for computer processing, the resulting vapor puff pattern becomes:

| | | | | |
|---|---|---|---|---|
| 1, | 0, | 0, | 0, | 0 |
| 1, | 0, | 0, | 0, | 0 |
| 1, | 0, | 0, | 0, | 0 |
| 1, | 1, | 1, | 1, | 1 |

Thus, the data organization for each character in the aerial message file (see FIG. 14) corresponds, in one embodiment, to the aerial view of the characters. In order to associate the lines of the vapor puff pattern with its particular character, the character is advantageously inserted as the first symbol in the lines of corresponding vapor puff data.

| | | | | | |
|---|---|---|---|---|---|
| L, | 1, | 0, | 0, | 0, | 0 |
| L, | 1, | 0, | 0, | 0, | 0 |
| L, | 1, | 0, | 0, | 0, | 0 |
| L, | 1, | 1, | 1, | 1, | 1 |

Thus, for example, in parsing for the vapor puff pattern corresponding to an "L" character in the English library, the process scans the English library file 1302 for all puff data lines beginning with an "L" character and extracts these puff data lines (for example, the four lines shown above). Once the corresponding lines of puff data (also referred to as the character data) is extracted from the library file 1302, the data is saved in state 1212 (FIG. 12) into the newly created aerial message file 1402.

In one embodiment, the puff data is inserted into the aerial message file 1402 in a specific order; thus, the character symbol is unnecessary and not copied into the new file 1402. Alternatively, it will be understood by those in the relevant art that any binary representation may be used to represent the vapor puff patterns. For messages incorporating characters from multiple languages, the methods determine the appropriate library file (based on a unique library file identifier associated with each character in the message received in state 1204), check the library file and extract the corresponding puff data.

The process next determines in state 1214 the user-specified (or default) spacing between the current character and the next character and inserts spacing data 1404 (see FIG. 14) into the aerial message file 1402 before proceeding to state 1216. The spacing data 1404 are lines of 0s, which indicate a no puff state. In one embodiment, the greater the desired spacing between individual characters, the more lines of 0s that are inserted into the aerial message file 1402. Thus, for example, a default spacing of 12 (see discussion with FIG. 11 and font spacing box 1108) results in twelve lines of 0s being inserted into the aerial message file 1402. In state 1216, the process determines whether there is another character in the message. If, in state 1216, it is determined that there is another character in the received message, the process proceeds to state 1218, where the next character is read from the received message. States 1210–1216 are repeated for the character. If, in state 1216, it is determined that there are no remaining characters in the received message, the process proceeds to state 1220, where the number of vapor puffs required by each aircraft is calculated by the calculation module 806 and stored in the aerial message file 1402. In one embodiment, the calculation of the number of required puffs is performed by adding the number of puff indications (or the 1's) in each column, where each column is associated with a particular aircraft formation position 204. The aerial message file 1402 is closed in state 1222 and the process ends in state 1224.

Figure 14:
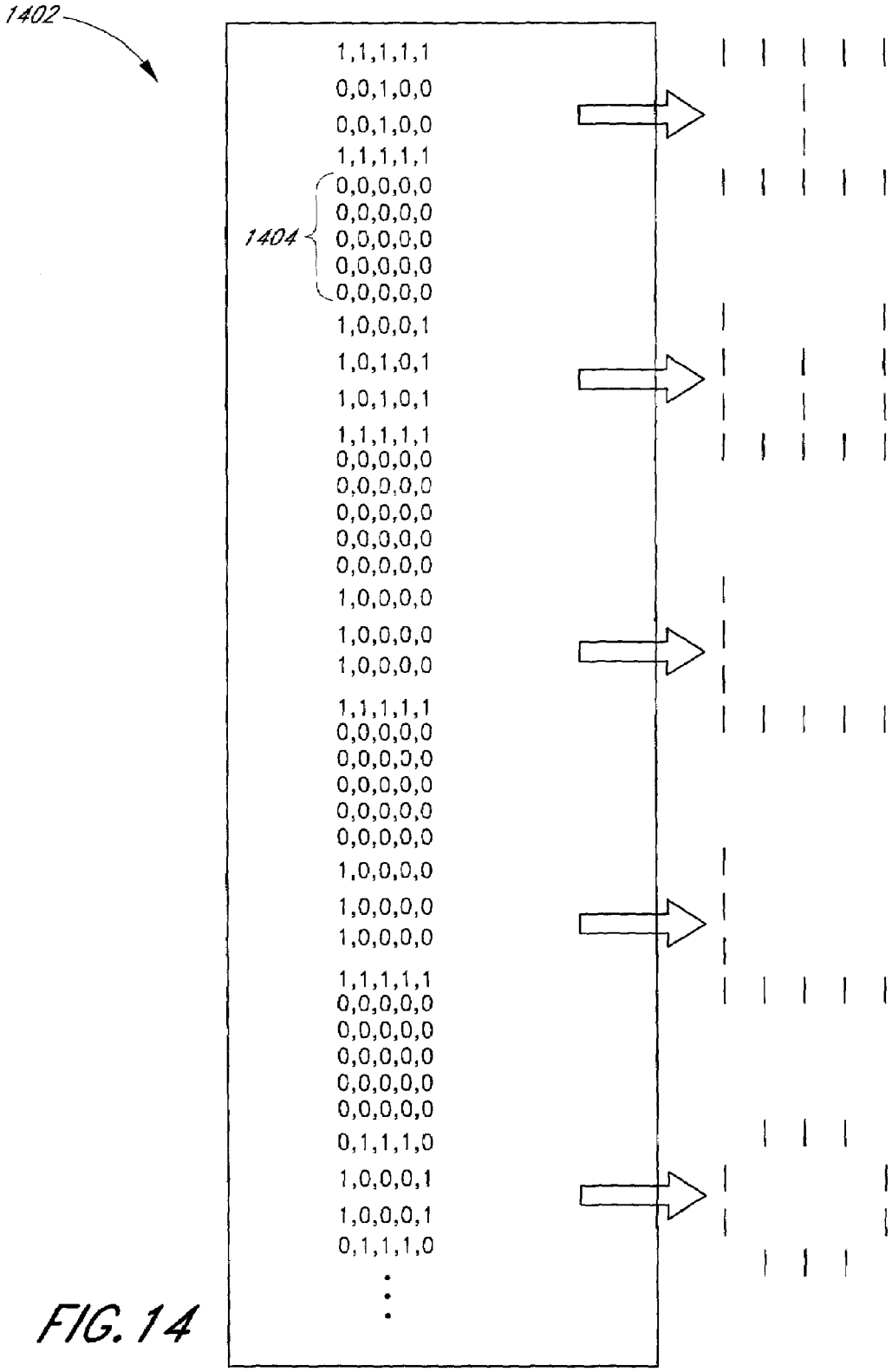
FIG. 14 illustrates a portion of an example aerial message file according to one embodiment of the invention.

FIG. 13, discussed above, illustrates a portion of an example English character library file 1302 according to one embodiment of the invention. Using analogous principles, character files for any language or for any purpose can be created. FIG. 14 illustrates an example aerial message file 1402 according to one embodiment of the invention, the example file spells out "HELLO." In one embodiment, the number of puffs required by the aircraft in each formation position 204 is recorded in the aerial message file 1402.

B. Printing An Aerial Message

A user (master pilot or ground control user) controls the printing of the aerial message using the aerial message software running on the master computer 404. The graphical user interface and related methods involved in printing an aerial message will now be described with reference to FIGS. 15–22.

1. Graphical User Interface

Figure 15:
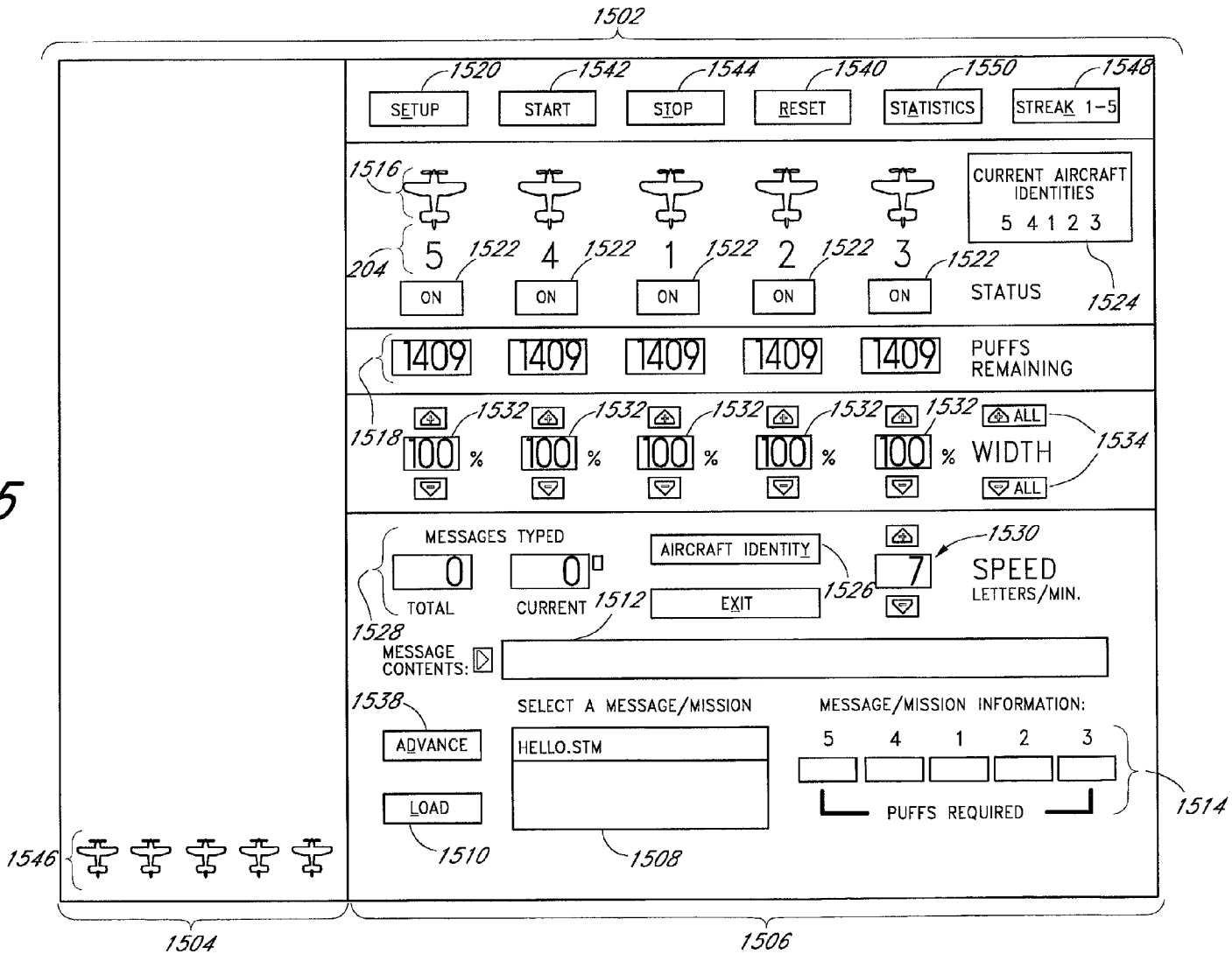
FIG. 15 illustrates an example message printing screen according to one embodiment of the invention.

From the main menu screen (FIG. 10), a user selects the option 1006 to print an aerial message. Upon selecting option 1006, a print message screen 1502 is displayed. FIG. 15 illustrates an example print message screen 1502 for the aerial message software according to one embodiment of the invention. The print message screen 1502 includes a simulation window 1504 and a detailed control window 1506. A graphical representation of the aircraft 1516 is displayed in control window 1506 along with numbered aircraft flight formation positions 204. A user selects and loads an aerial message to be printed (composed as described above) from a scrollable message/mission box 1508. Thus, for example, having composed an aerial message stating "Hello," a user loads (for example, by highlighting the message named "hello.stm" and selecting a load option 1510) the "hello" message for aerial printing.

Figure 16:
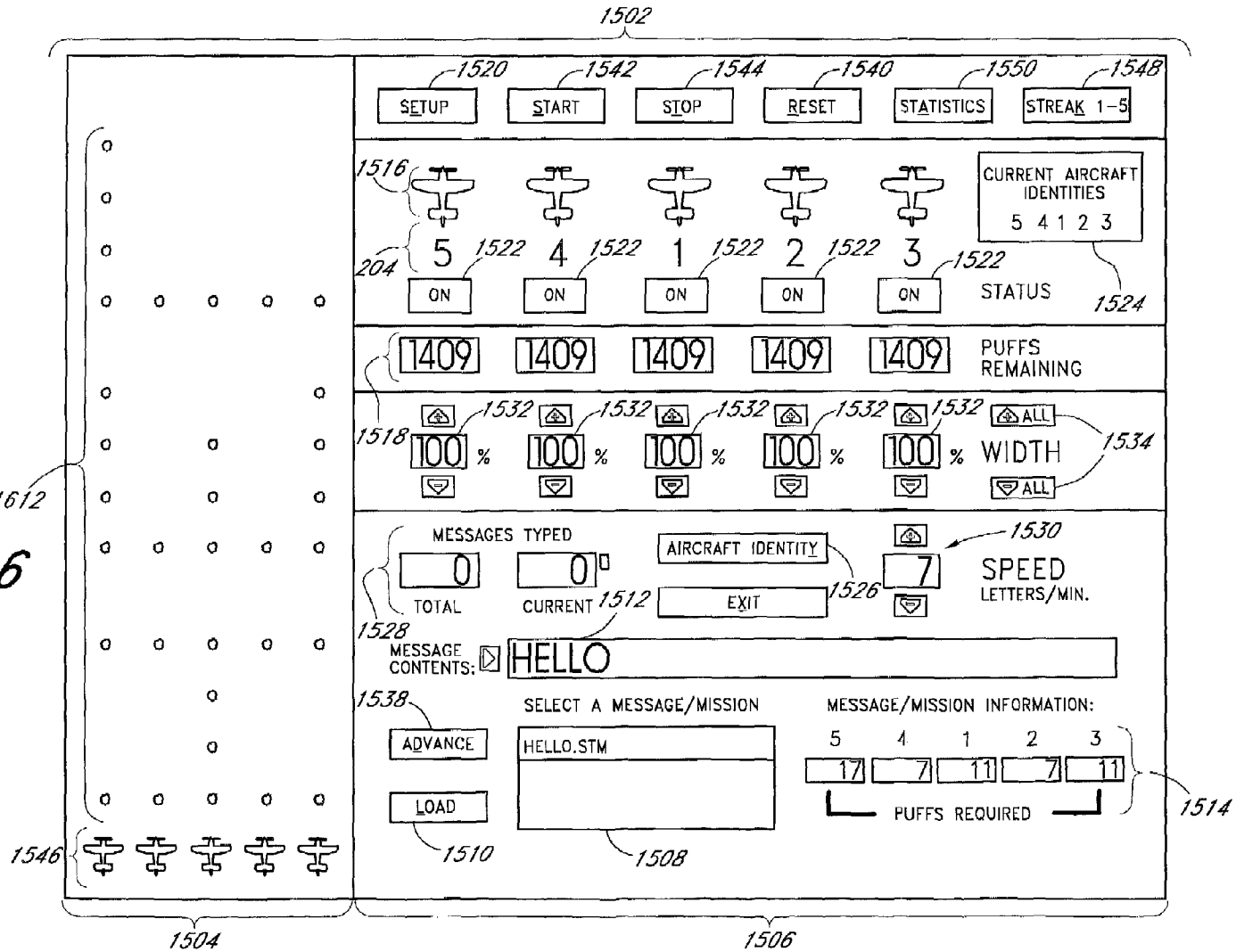
FIG. 16 illustrates an example message printing screen, after a message has been loaded, according to one embodiment of the invention.

FIG. 16 illustrates the print message screen 1502, according to one embodiment of the invention, after the "hello" message has been loaded into the system. The content of the loaded message is displayed in a message contents window 1512. A graphical representation of the message is displayed in simulation window 1504 with images of vapor puffs forming the graphical representation of the aerial message. In the alternative, only a portion of the message may be viewable at any given time in the simulation window 1504. The simulation window 1504 displays the message from its aerial view, but alternatively may display the message from a ground view.

An indication of the number of vapor puffs required to print the "Hello" message is displayed in box 1514. As indicated by box 1514 in FIG. 16, seventeen puffs are required by the aircraft in the number 5 position, seven puffs are required by the aircraft in the number 4 position, eleven puffs are required by the aircraft in the number 1 position, seven puffs are required by the aircraft in the number 2 position, and eleven puffs are required by the aircraft in the number 3 position. As indicated by box 1514, the number of puffs required by the aircraft in the number 5 position is over double the number of puffs required by the aircraft in the number 4 position. This is often true when printing English block letters because the block letters often require more horizontal strokes at the top and bottom of the letter than in the middle of the letter. Thus, in displaying the required puffs prior to printing the message, the user is better able to determine whether there will be a need to switch aircraft at some point during flight.

The print message screen 1502 also includes information about the number of puffs remaining in each aircraft 1518, the number of messages printed during a flight 1528, and the speed for printing the aerial message 1530. The box 1518 associated with a particular aircraft, in one embodiment, decrements for each vapor puff created by the particular aircraft. In another embodiment, the puffs remaining is determined using the sensors on the vapor tanks in each aircraft 102,104, where the control box of each aircraft transmits vapor level data to the aerial message software. A user may also alter the width of the vapor puffs (and thus the characters) being created for each aircraft on an aircraft-by-aircraft basis using a selectable width parameter 1532 or collectively for all aircraft at once using a global width parameter 1534. By allowing for the width of the vapor puffs to be altered on an aircraft-by-aircraft basis, the methods compensate for different vapor densities generally produced by different aircraft types/models. Thus, the methods provide greater flexibility in creating uniform vapor puffs even though different models of aircraft may be used within a single aircraft formation. The user is also provided an advance option 1538 to advance (or forward) the message to some intermediate point in the message. Printing of the message, if started, then begins at the intermediate point to which the message was advanced. A reset option 1540 is provided to reset the message to its starting point.

Before printing the aerial message, the user enables each of the aircraft by selecting a setup option 1520. Enabling the aircraft ensures that each of the aircraft is able to communicate with the aerial message software and receive instructions from the aerial message software system by establishing an open socket with each aircraft. Once enabled, a visual indicator appears on the print message screen 1502 indicating that each aircraft is properly enabled (that the socket was successfully established). In one embodiment, the visual indication is a green highlight outlining the "ON" graphic 1522 for each aircraft. A disabled aircraft displays an "OFF" graphic 1522 (only shown with "ON" indicator). Alternatively, in another embodiment, the aerial message system performs an automatic connection/enabling process without any specific action being taken by the user. Data is transmitted to a particular enabled aircraft by writing the data to the socket established with that aircraft. Thus, for example, if five aircraft are enabled, five sockets are opened by the aerial message software, one socket with each aircraft.

Figure 17:
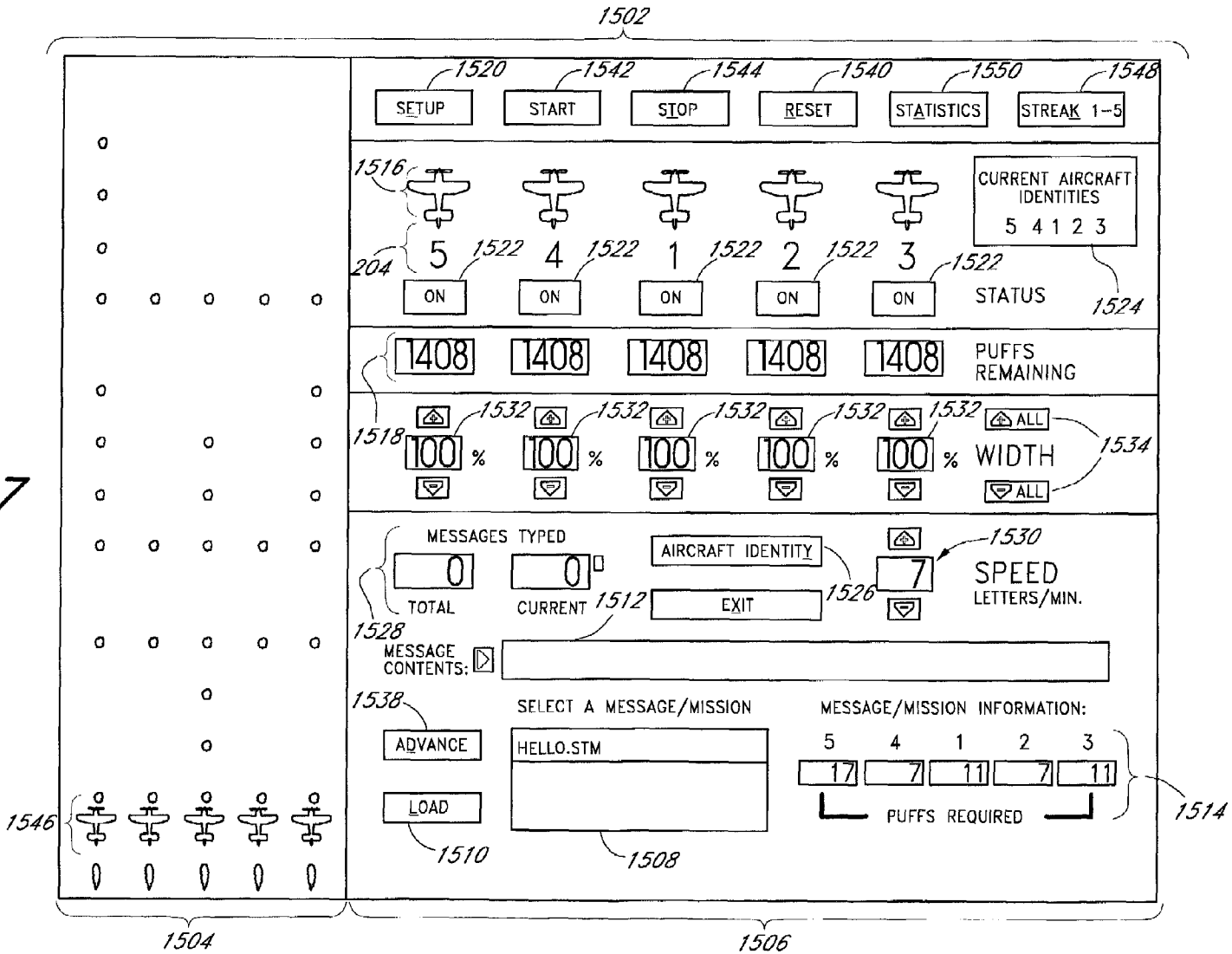
FIG. 17 illustrates an example message printing screen, after initiation of the printing, according to one embodiment of the invention.

After the aircraft are enabled, the user begins printing the message by selecting a start option 1542. Printing may be stopped at any time by selecting a stop option 1544. As shown in FIG. 17, the simulation window 1504 provides a real-time simulation of the actual printing process using miniature graphical representations 1546 of the aircraft. A graphical representation 1612 of the aerial message scrolls down toward the bottom of the simulation window 1504 in conjunction with the printing of the aerial message. Thus, when a line of graphical vapor puffs reaches the nose of the miniature graphical aircraft 1546, the simulation window 1504 depicts the graphical aircraft 1546 as emitting vapor or smoke. Thus, using portions of the data sent to each aircraft 102,104, the individual graphical aircraft 1546 in simulation window 1504 display a graphic of a vapor trail at the same time that its correspondingly positioned physical aircraft produces an actual vapor puff. Please see section V.B.2 for additional details on the simulation feature of the aerial message software.

Figure 18:
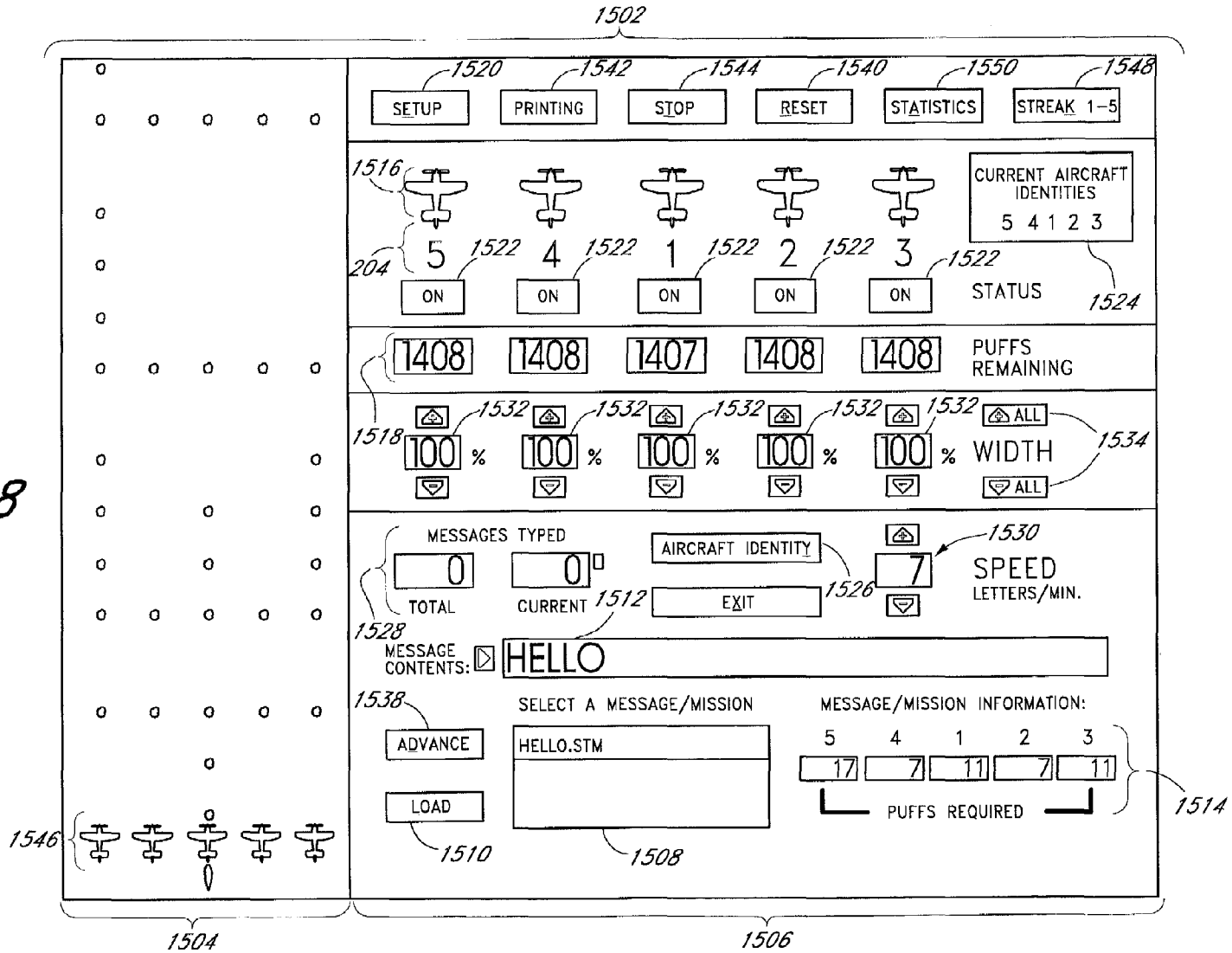
FIG. 18 illustrates an example message printing screen, as printing continues, according to one embodiment of the invention.

Because each graphic 1546 corresponds in real-time to its associated physical aircraft 102,104, a user may watch the miniature aircraft 1546 in simulation window 1504 to determine whether the vapor puffs actually being produced by the physical aircraft 102,104 are properly timed so that each aircraft is producing a vapor puff in correct alignment, thereby reducing the need to visually spot the actual aircraft to determine whether the vapor puffs are properly aligned. The real-time simulation feature greatly enhances a user's ability to easily detect and correct formation and/or system problems, especially when flying in formations for which it is difficult or even impossible for a master pilot to monitor the actual flight of the aircraft. Additionally, as a secondary visual clue, the vapor puff images highlight or alter colors as they reach the nose of the miniature aircraft 1546. FIGS. 17–18 illustrate a portion of the printing simulation, showing vapor trails on the miniature aircraft 1546 when each corresponding physical aircraft 102,104 emits an actual vapor puff during the course of printing the aerial message.

Another feature of the print message screen 1502 is the current aircraft identifies box 1524, which identifies what aircraft are located in what position 204 in the flight formation. Thus, as depicted in FIGS. 15–18, aircraft 5 is in position 5, aircraft 4 is in position 4, and so forth. The identities of the slave aircraft 104 may be readily altered to reposition the slave aircraft 104 into different positions in the flight formation by selecting an aircraft identities option

Figure 19A:
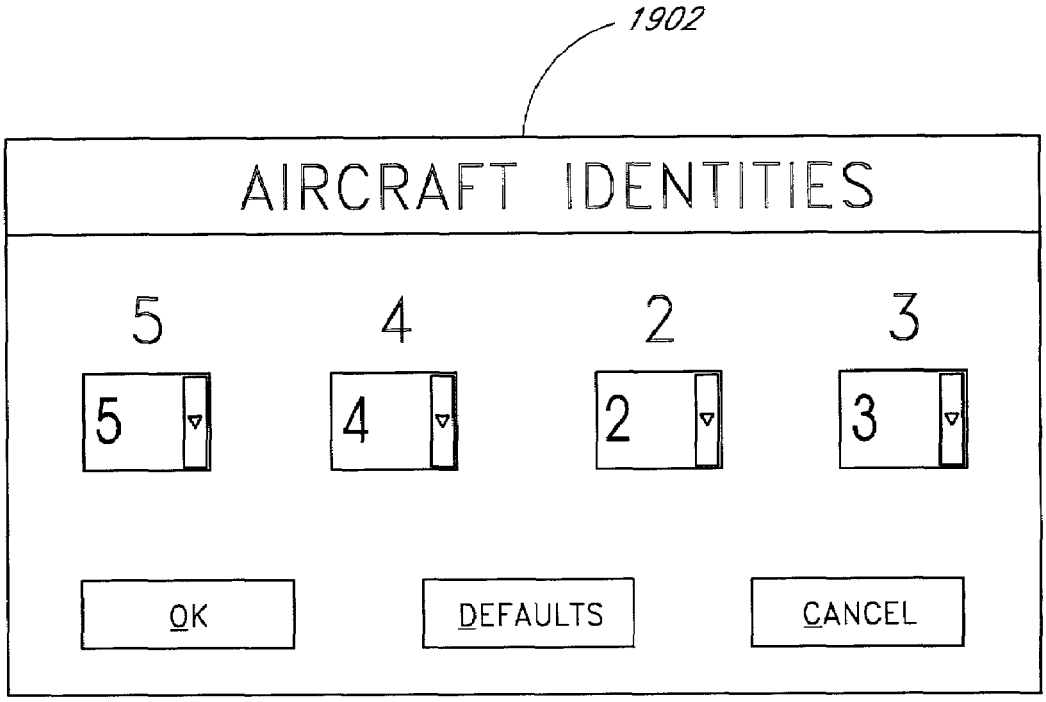
FIG. 19A illustrates an example aircraft identity screen according to one embodiment of the invention.
Figure 19B:
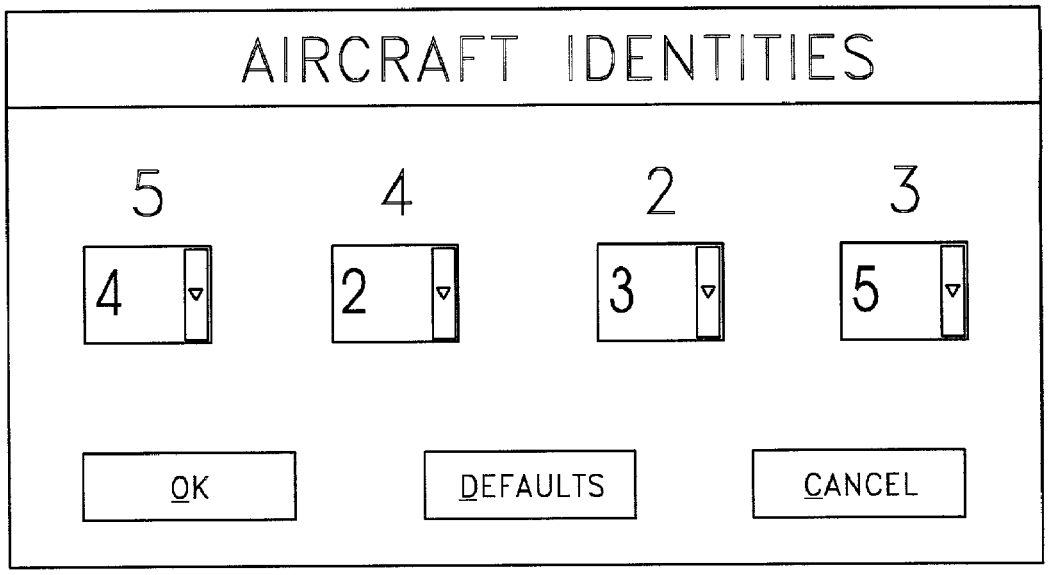
FIG. 19B illustrates an example aircraft identity screen, after switching aircraft positions, according to one embodiment of the invention.
Figure 20:
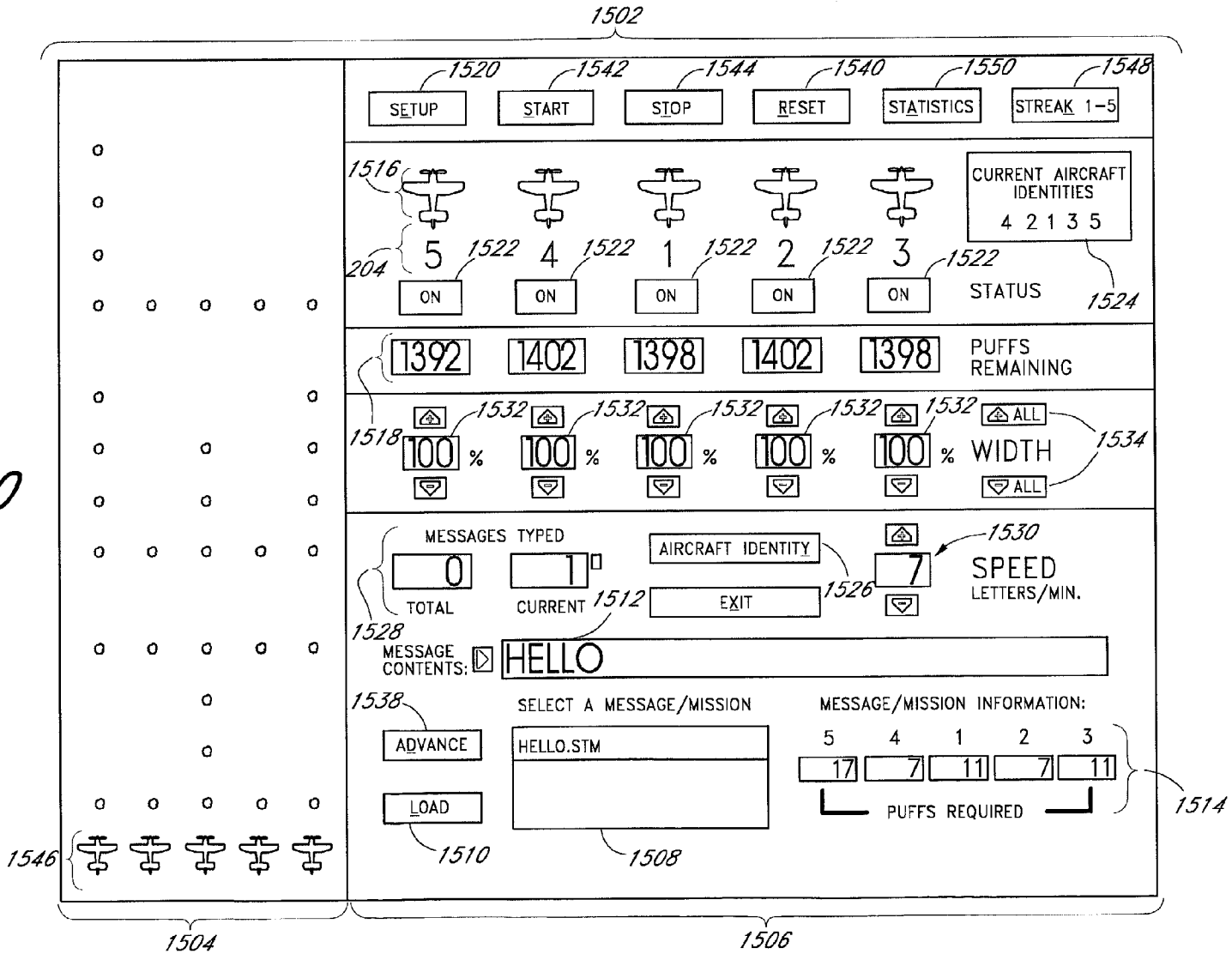
FIG. 20 illustrates an example message printing screen, after aircraft positions have been switched, according to one embodiment of the invention.
Figure 21:
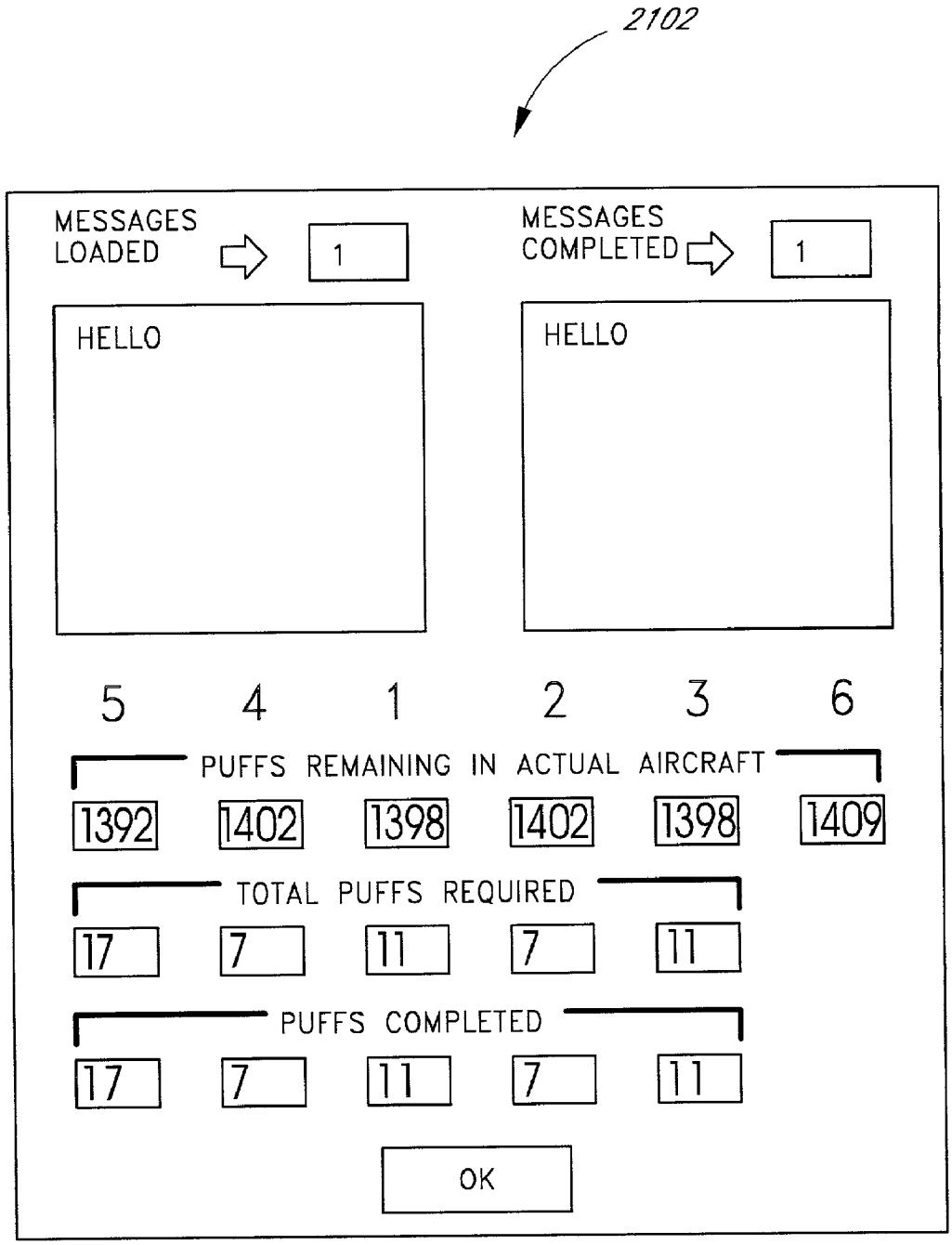
FIG. 21 illustrates an example statistics screen, after completion of an aerial message, according to one embodiment of the invention.

1526. In response to selecting this option 1526, a pop-up box 1902 (see FIGS. 19A and B) is displayed allowing the user to specify which slave aircraft 104 to place in what formation position. The default position for aircraft positions is depicted in FIG. 19A. FIG. 19B illustrates the repositioning of aircraft number 5 to flight formation position 3, aircraft number 4 to flight formation position 5, and so forth. After the slave aircraft 104 are relocated to different positions using option 1526, the current aircraft identifies box 1524 displays the newly set aircraft identities in FIG. 20.

Additionally, the aerial message software provides notification to a user of the software when an aircraft is out-of-range and no longer receiving network signals. In one embodiment, data packets are generated on a regular schedule (such as every second or every three seconds) to query each slave control box to determine whether the control box is receiving the data packets. Upon receiving the data packets, each slave control box 602 "echos" the data packet back to the aerial message software running on the master computer 404, thereby informing the aerial message software that the slave control box 602 is still in range and receiving network traffic. In the embodiment in which the master computer 404 is located at a ground control station, the aerial message software likewise queries (monitors) the master control box to determine whether the master control box is still in range and receiving data packets from the aerial message software. In the alternative, a global positioning system (GPS) tracks the location of each aircraft and its position in the flight formation, and provides the basis for the out-of-range determination and notification.

If the aerial message software does not receive a echo response from a particular slave control box 602 within a prescribed time period, the software notifies the user that the slave control box 602 is out-of-range. The notification is provided using various indicators, such as, for example, an audible indication to the user that an aircraft is out-of-range. In other embodiments, the particular aircraft graphic 1546 associated with the non-responsive aircraft changes color (for example, the graphic turns red), an indicator mark (for example, an exclamation point or asterisk) is displayed next to the aircraft graphic 1546, and/or the graphic 1522 displays an "OFF" indication (rather than the "ON" graphic shown in FIG. 15).

Several other features are also accessible from the print message screen 1502. The streak 1–5 feature 1548 allows the user to streak (i.e., simultaneously signal for vapor emissions) from all aircraft to test whether each aircraft is receiving packets correctly and producing vapor. The user may also get statistics on the system by selecting the statistics option 1550. A statistics pop-up box 2102 is displayed that informs the user the number and name of each message loaded and completed, the number of puffs actually remaining in each aircraft, the total puffs required for a message, and the number of puffs completed.

2. Printing Methods

Figure 22:
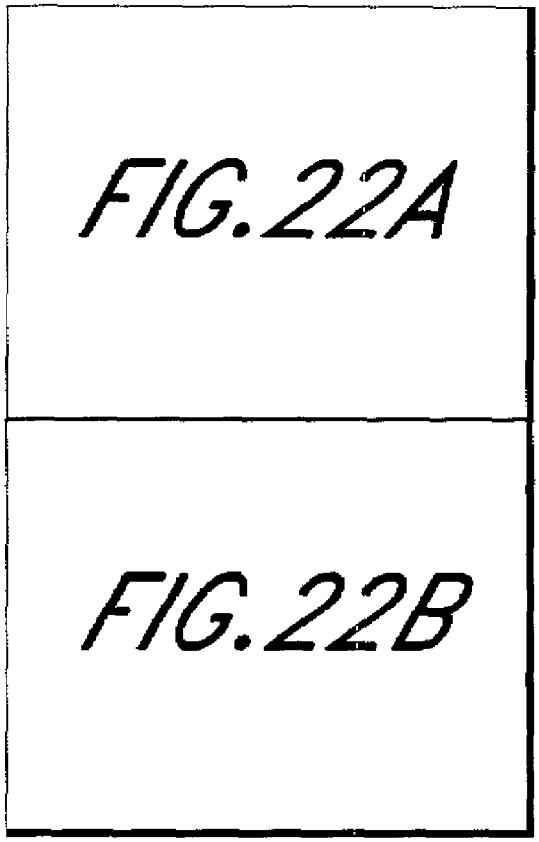
FIG. 22 illustrates a flow chart for printing an aerial message according to one embodiment of the invention.
Figure 22B:
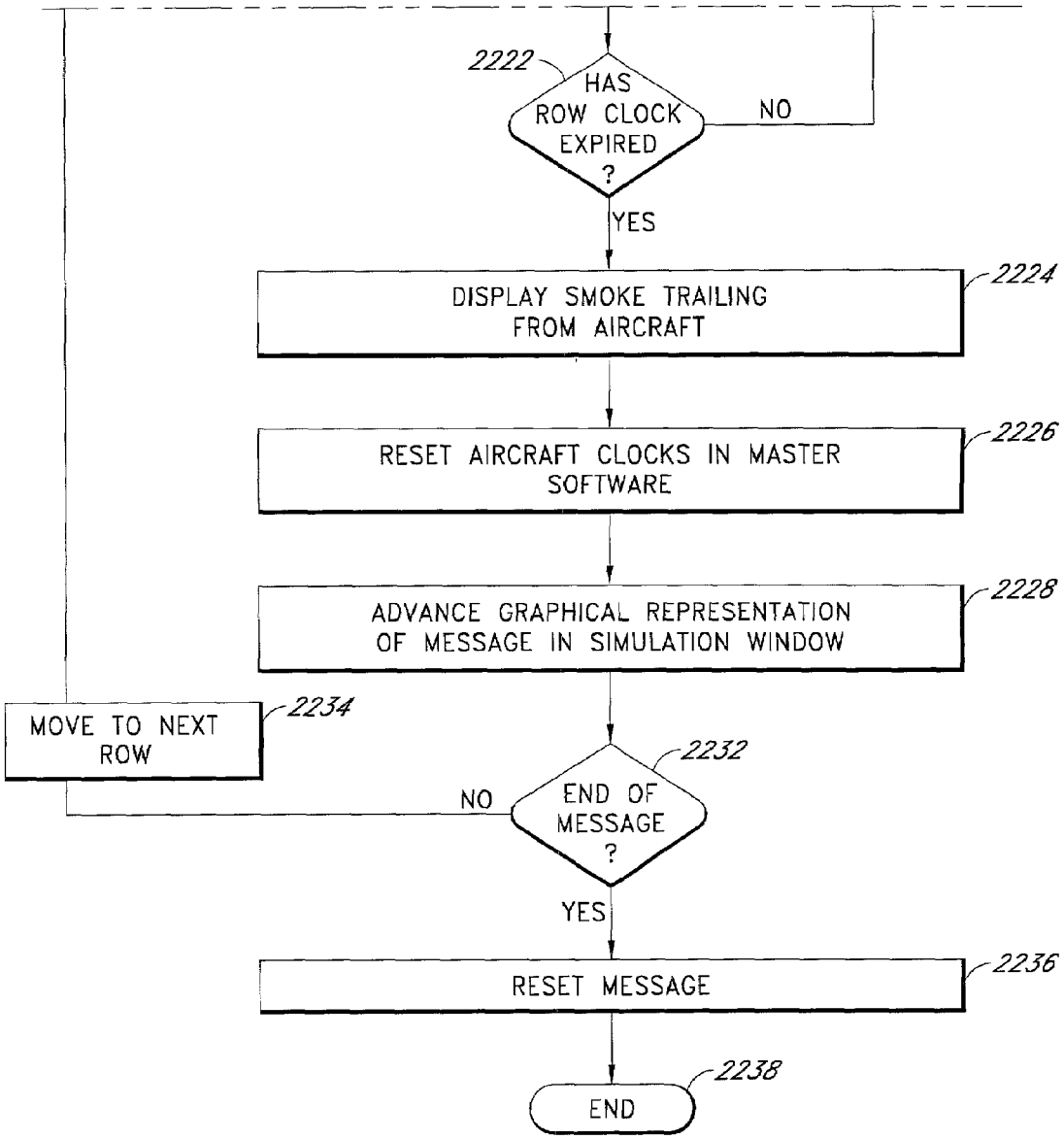

One embodiment of the printing process will now be described in further detail with reference to FIG. 22. Beginning at a start state 2202, the printing process proceeds to the next state 2204, wherein an aerial message is loaded into memory. In state 2206, the graphical representation of the message using graphical vapor puffs is displayed in the simulation window 1504. In one embodiment, this is accomplished by reading the aerial message file 1402 from top to bottom and displaying a vapor puff graphic image for each indication of a vapor puff to be created (i.e., each 1 read from the aerial message file). After loading the message, the process receives an indication in state 2208 to begin printing the aerial message. In one embodiment (not shown), the process sends a signal to each of the control boxes 402, 302 instructing the respective control boxes to turn on the pumps 422, 616.

Beginning with states 2210, for each row of character data in the aerial message file 1402 the process continues to state 2211 in which the character speed 1530 is read from the display screen 1506. In state 2213, a row clock is set to a value associated with the character speed determined in state 2211. Beginning in state 2212, for each aircraft 102,104 the printing process and data packet generation module 808 create a data packet, in state 2214, including an indication of whether the aircraft is to emit a vapor puff, a specified duration for the vapor puff and any needed time delay between the slave control box 602 receiving the data packet and emitting the vapor puff.

In one embodiment, the time delay (between a slave aircraft receiving a data packet and sending a signal to open the solenoid valve) is based on each aircraft's position in the flight formation and/or the particular flight formation being used, and is dynamically read from the aerial message software each time a data packet is created. For example, if the aircraft are flying in a line abreast formation, the only time delay necessary is associated with the amount of time it takes the aerial message software to generate and send data packets to each of the aircraft. In the line abreast example, the following time delays operate to form aligned vapor puffs:

| aircraft position: | 5 | 4 | 1 | 2 | 3 |
|---|---|---|---|---|---|
| time delay (milliseconds) | 300 | 200 | 100 | 50 | 0 |

Thus, the time delay associated with the data packet sent to the aircraft in formation position 5 is 300 milliseconds, the time delay sent to the aircraft in formation position 4 is 200 milliseconds, and so forth. As illustrated by this example embodiment, a time period of approximately 300 milliseconds elapses from sending the first data packet to sending the last data pack for each character data row. This time delay operates as a default time delay associated with the speed of processing each row of character data.

In the example embodiment in which the aircraft fly in a V formation, an additional time delay associated with the V formation is generated using various algebraic relationships and known variables. For example, using a V formation with each aircraft having a lateral distance between the aircraft of 200 feet and a sweep back angle of 15°, the formation is depicted as follows:

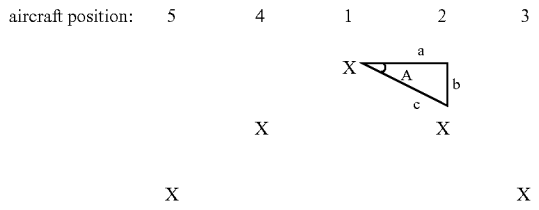

In the depicted illustration, angle A denotes the sweep back position of aircraft 2 (and aircraft 4) and "a" denotes the lateral distance between aircraft 1 and aircraft 2. Side "b" denotes the fore/aft distance of aircraft 2 from aircraft 1. In order to create substantially aligned vapor puffs, if aircraft 1 creates a vapor puff at a given time, aircraft 2 waits until it is substantially aligned with the vapor puff created by aircraft 1 before producing a vapor puff. Knowing the airspeed of aircraft 2, the lateral distance between aircraft, and the sweep back angle, the aerial message dynamically determines the distance b and the time required for aircraft 2 to travel distance b, using the following formulas:

$$b^2=c^2a^2$$

where c=a/cosine A, and $$t=b/r,$$

where r is the airspeed of the aircraft in feet/sec and t is the time in seconds required for the aircraft to travel distance b. The time t is added to the constant delay time associated with processing each row of character data. Thus, for the aircraft in position 2 of the above example, the time delay measurement transmitted to aircraft 2 equals 50 ms+t. For a specific illustration of the time delay measurement, please see section VI below.

Figure 26:
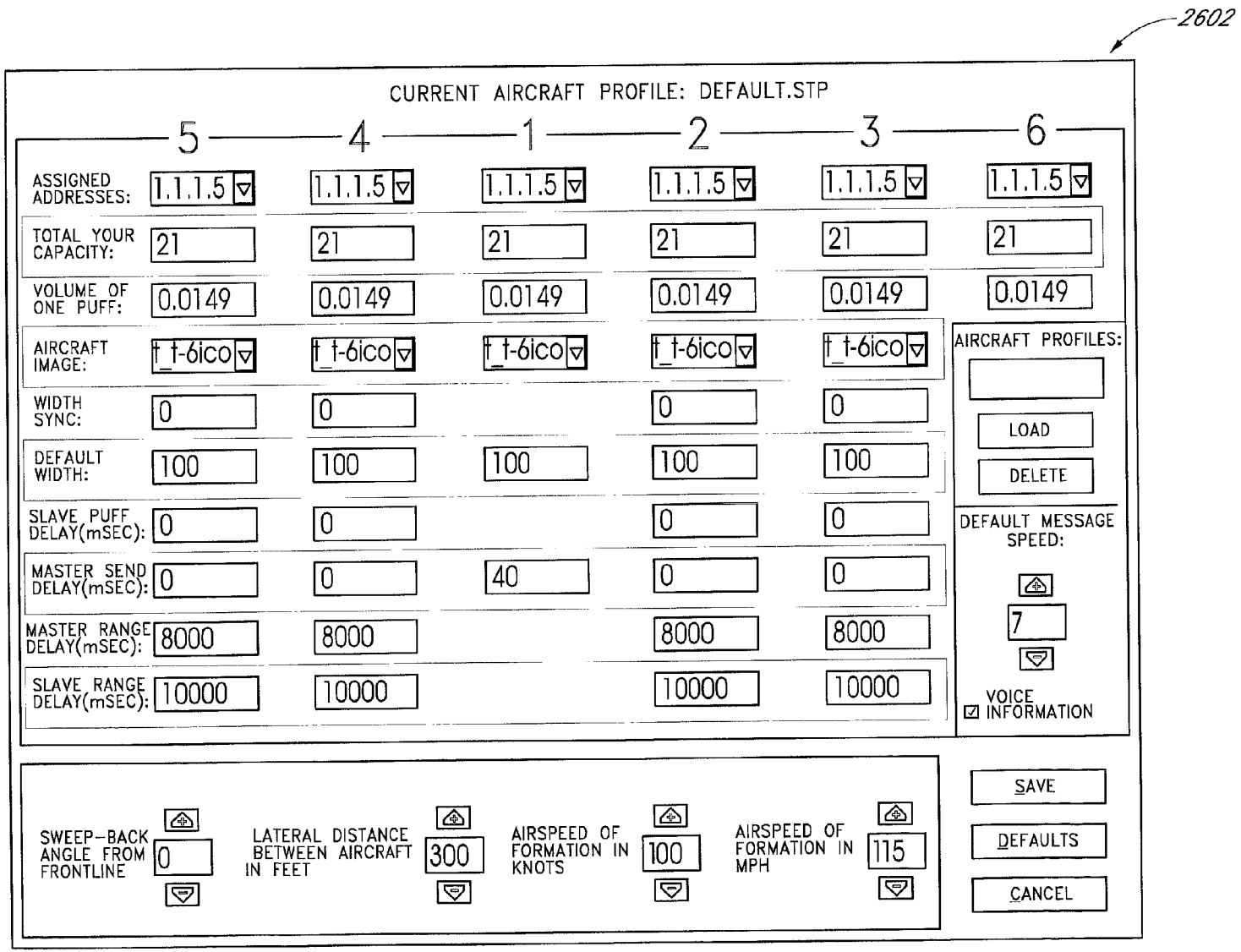
FIG. 26 illustrates an example aircraft profile screen according to one embodiment of the invention.

Alternatively, the time delay value is set to a default value in the aircraft profile database 824, and may be altered using profile screen 2602 (see FIG. 26). In other embodiments a GPS system is used to calculate the time delay for each aircraft. The duration measurement of the data packet is determined by dynamically reading the width value from the print message screen 1502 (as recorded by the user in the width parameter 1532, 1534) corresponding the particular aircraft. As indicated above, the duration measurement corresponds to a length of time that the solenoid value remains open in a given aircraft. The data packet is sent to the aircraft in state 2216, and in state 2218 a delay clock in the master computer 404 is activated. The master computer delay clock is associated with a graphic of one of the miniature aircraft (the one to which the packet was transmitted in state 2216). By having a master computer delay clock associated with a particular physical aircraft and by having the clock activated with the same delay value transmitted to the physical aircraft, the graphic of the miniature aircraft is synchronized with the physical aircraft and knows when to emit a smoke graphic to correlate with the actual vapor puff being created by the respective physical aircraft.

The process determines in state 2220 whether the process has reached the end of the character data row. Each row of the aerial message file 1402 is referred to as a character data row. If the end of the row has not been reached, the process proceeds to state 2221, in which the next aircraft data (the next column in the row) is read and then states 2214–2220 are repeated for that aircraft. If, in state 2220, the end of the character data row has been reached, the process proceeds to state 2222 in which the process determines whether the row clock has expired. If not, the process waits until the row clock expires before proceeding to state 2224. If the row clock has expired and the aircraft clocks (the ones associate with each graphic 1546) have expired, in state 2224, a graphic of a vapor puff is displayed for the duration specified in the original data packet sent to each aircraft. After the smoke is displayed, the master computer time delay clock for each aircraft graphic is reset in the master software in state 2226. In state 2228, the graphical representation 1612 of the aerial message is advanced in the simulation window 1504 as the next character data row of the aerial message data file 1402 is read. In state 2232, the process determines whether the end of the aerial message file 1402 has been reached. If the end of the message is reached in state 2232, the aerial message is reset in state 2236 and the process proceeds to an end state 2238. Otherwise, the process moves to the next row in state 2234 and states 2212–2232 are repeated for the next character data row until the end of the aerial message file 1402 is reached. In one embodiment (not shown), prior to proceeding to the end state 2238, the process sends a signal to each of the control boxes 402, 302 instructing the respective control boxes to turn off the pumps 422, 616.

C. Creating a Character Library

Figure 24:
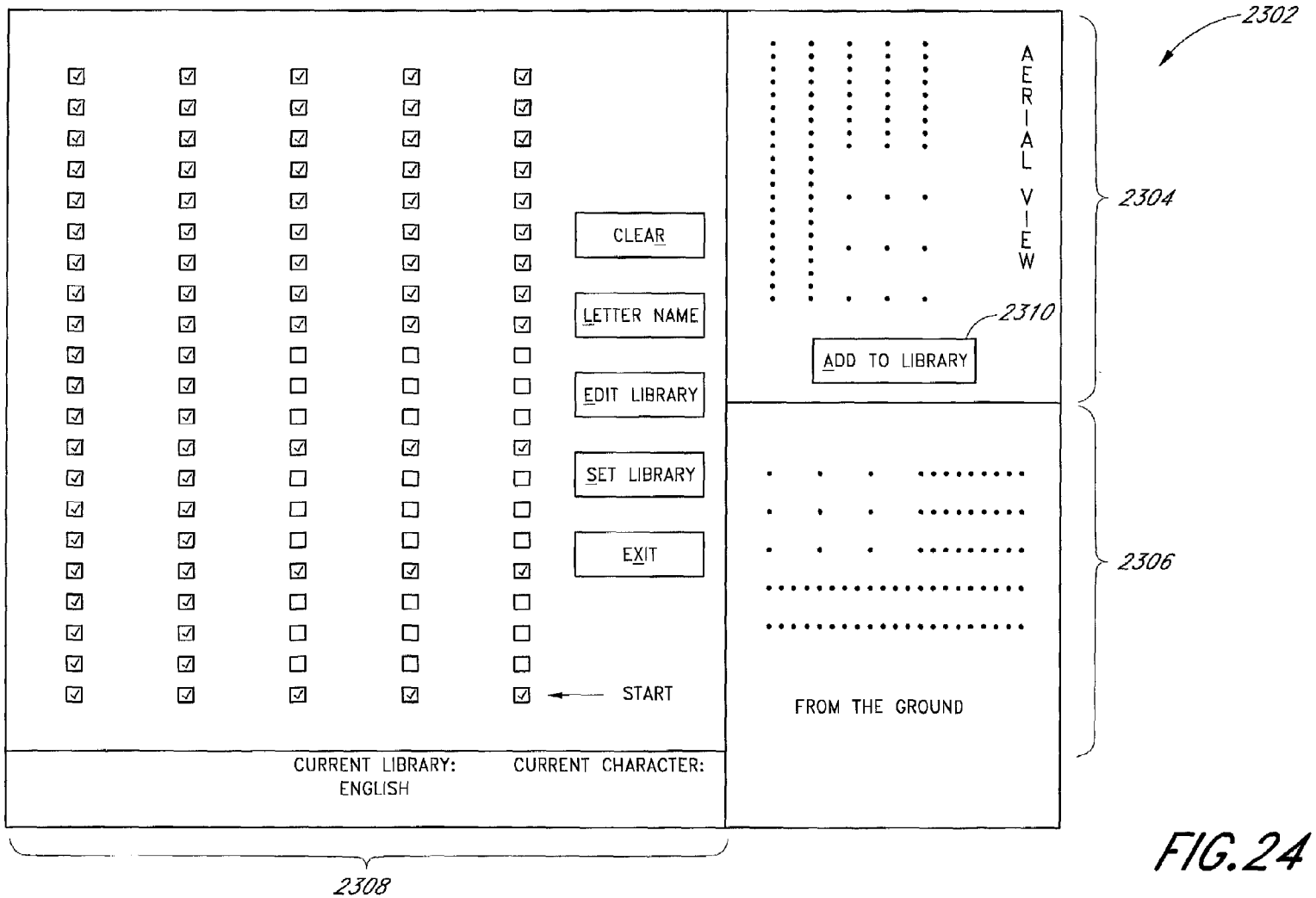
FIG. 24 illustrates an example library character creation screen according to one embodiment of the invention.
Figure 25:
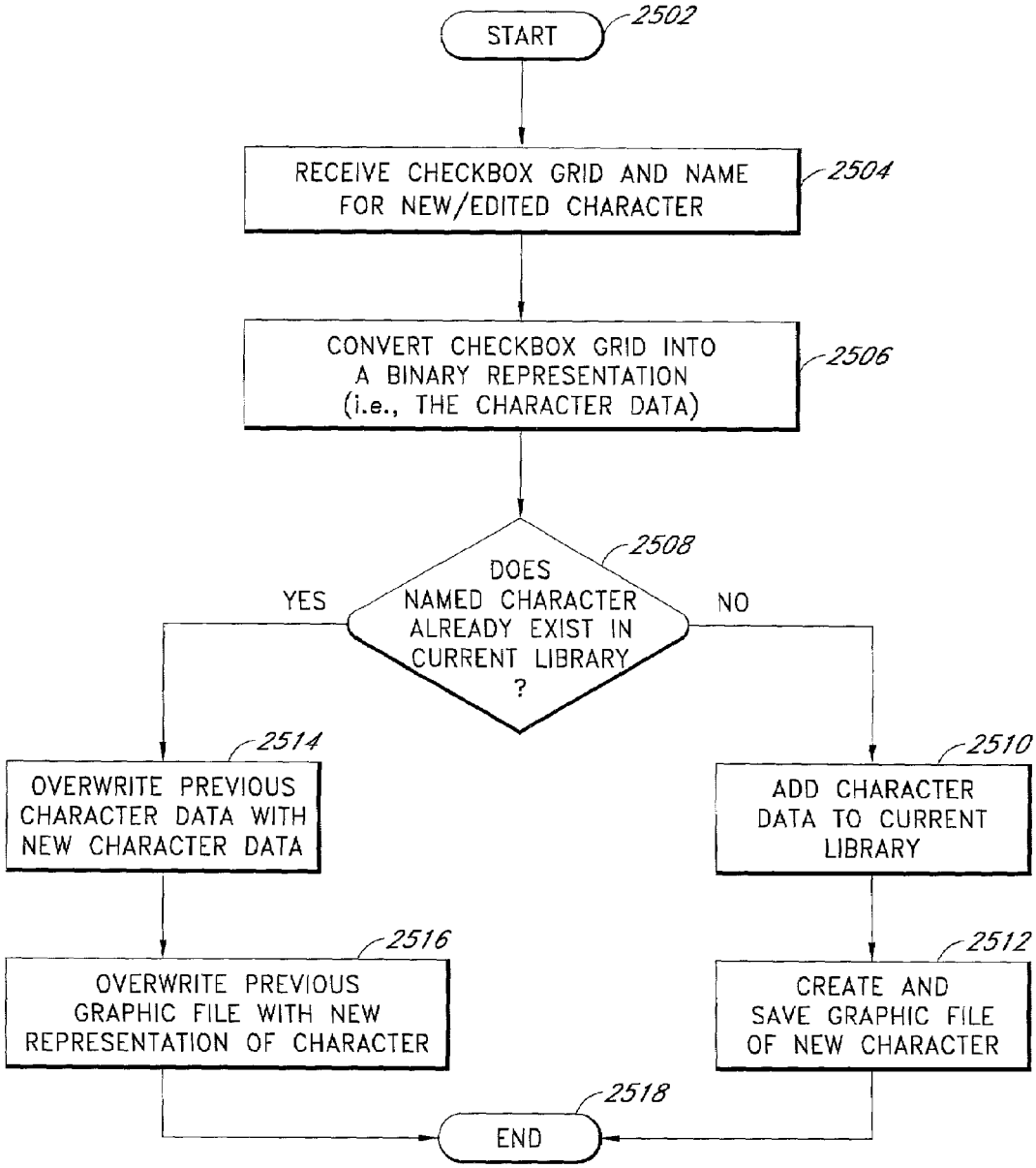
FIG. 25 illustrates a flow chart for creating a library character according to one embodiment of the invention.

The user interface and related methods involved in creating a character library will now be described with reference to FIGS. 23–25.

1. Graphical User Interface

A user may create characters that are not already part of an existing character library, such as a graphical image or business logo using the character library option 1008 from the main menu (FIG. 10). In response to selecting the character library option, the user is presented with a character library screen 2302 in FIG. 23. FIG. 23 illustrates the creation of the number 5 for the English character library. As illustrated in FIG. 23, the character is created by selecting checkboxes to form a pattern corresponding to the desired character. As the user selects checkboxes in the character grid 2308, the corresponding images are displayed in the aerial view 2304 and the ground view 2306 windows. FIG. 24 illustrates the use of the character library to create graphical images, such as a flag of the United States, by selecting the checkboxes corresponding to a needed pattern of vapor puffs. For large characters exceeding the space provided by the character grid 2308, the user may create portions of the character among multiple files, where the multiple files may be joined together to compose one large message in the compose message screen 1102. Options are provided to clear the work, name the character, edit an existing character library, and add a character to an existing library.

2. Character Creation Methods

One embodiment of a character creation process will now be described in further detail with reference to FIG. 25. Beginning at a start state 2502, the process continues to a next state 2504, where the process receives the checkbox grid data and a user-specified name for the created character. The grid data is converted to a binary representation (i.e., called character data—1's and 0's) in state 2506. A check is made in state 2508 to determine whether the specified character already exists in the current library. If the character does not exist in the current library, the character data is added to the current library in state 2510 and in state 2512 a graphic file is created for the new character. If in state 2508, it is determined that the character does exist in the current library, in state 2514, the previous character data is overwritten with the new character data. In one embodiment, the user is provided a confirmation prompt informing the user that the character already exists and prompting for another character name from the user. In state 2516, the previous graphic file is also overwritten, or alternatively, an appropriate message prompt is given to the user. The graphic file is subsequently displayed above the icons 1104 in the compose message screen 1102. The process continues to an end state 2518.

D. Additional Software Features

Several additional features are provided by the aerial message software. FIG. 26 illustrates an aircraft profile screen 2602, which stores an aircraft profile record for various aircraft models, including, for example, propeller and jet aircraft. The aircraft profile includes information on the particular aircraft, such as, for example, the capacity of the vapor material tank for the particular aircraft. As depicted, a user of the aerial message software may modify a time delay from the aircraft profile to account for various changes to aircraft formation (such as by using a sweep back angle) or other parameters (such as altering the distance between aircraft or the speed of the aircraft).

Additionally, a security feature is provided in which the aerial message software is operable only when activated with a system security file (not shown). The system security file is associated only with a specific component of the system hardware, such as, for example, a unique identifier of a hard drive located in the master computer. Because the aerial message software requires the system security file before loading the software, unauthorized copies of the software are inoperable. The system security file may be configured to provide access to the aerial message software for a specified time duration (such as, for example, a month) or for a specified number of aerial messages (such as, for example, up to 12 aerial messages).

A tracking and accounting feature is provided which allows an administrator to remotely monitor aircraft fleets established throughout the United States or in various countries around the world, with the master computer of each fleet (or group) maintaining an aerial message log. After completion of an aerial message, the methods and systems update the message log stored on the master computer with information pertaining to each aerial message created. Using remote access or other methods, the administrator or another user is able to upload a message log file (not shown) to a central computer system. Using the message log file, an administrator of the central computer system is able to determine information pertaining to each aerial message, such as, for example, the contents of a printed aerial message, the date and time the message was printed, and/or the location (for example, using a GPS receiver) where the aerial message was printed. Alternatively, the master computer may be connected to the World Wide Web via a wireless connection and transmit such message log information to a central computer (or a server) each time an aerial message is printed or each time the printing of an aerial message is initiated. A report may be generated from the message log detailing the information contained in the message log. The tracking and accounting feature thereby provides a convenient way to determine fees for potential licensees or clients. Additionally, the administrator may troubleshoot systems remotely or view system/aircraft parameters.

VI. Operation

An example of the systems and methods in operation will now be described in which a user of the master computer desires to create an aerial message reading "HELLO." Using the compose message screen, the user types or otherwise enters the message "HELLO" into the message window and selects an option to save the aerial message, naming the message "hello.stm." The software generates an aerial message file as discussed above (see FIGS. 13 and 14).

To print the aerial message, the user goes to the message printing screen and loads the "hello.stm" file into the aerial message software. Once the user has selected an option to load the "hello.stm" file, a graphical representation of the "HELLO" message is displayed in a simulation window. The displayed graphical representation in the simulation depicts the message in an aerial view format. The user next enables all of the aircraft in the formation, which establishes an open socket with each aircraft. After the user selects a start printing option, the aerial message software begins generating and transmitting data packets to each of the aircraft. The data packets include an IP address of the aircraft to which the data packet is directed, an indication of whether to create a vapor puff, a time delay measurement, and a duration measurement.

For example, to create the line of vapor puffs corresponding to the first character data row of the aerial message file including "HELLO," the process reads the data in the first character row, which appears as follows:

1, 1, 1, 1, 1

Before reading the value in the first column, the aerial message software sets a row clock to a character speed value specified by the user. The row clock is used to determine how fast the aerial message software reads each row of character data. After setting the row clock, the software reads the value in the first column. Because there is a "1" in the first column of the first row, the process knows to send an indication to aircraft 5 to make a vapor puff. In our example, (see FIG. 2) aircraft 5 has an IP address of 1.1.1.5. The duration measure is read from the width parameter displayed on the screen of the message printing software. The default width of 100 generates a duration measurement of one second.

The time delay measurement is determined based on the aircraft speed, the lateral distance between aircraft, and the sweep back angle of the flight formation. Thus, if the user desires to fly in a V formation, the user sets the system settings using the system setting option from the main menu screen of the aerial message software. Suppose, for example, the user decides to fly with a sweep back angle of 15 degrees and with a lateral distance of 200 feet. The user then enters the sweep back angle, lateral distance and airspeed into the aerial message software (see FIG. 29). A diagram illustrating this example is shown below:

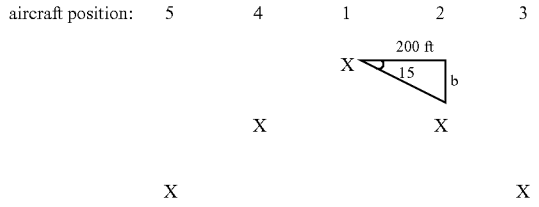

Thus, using the quadratic formula $b^2=c^2-a^2$, the computer determines that b is equal to the following value:

$$b=sqrt[(200\text{ feet/cosine }15)^2-(200\text{ feet})^2]$$

If the airspeed of the aircraft in feet/second is 528,000 feet/3600 sec (also 200 miles/hour), the software uses the formula t=b/r to determine that the time for aircraft 2 to travel distance b is as follows:

$$t=\frac{sqrt\left[(200\text{ feet/cosine }15)^2-(200\text{ feet})^2\right]}{[528{,}000\text{ feet}/3600\text{ sec}]}=\frac{53.4}{146.7}=36.4\text{ ms}$$

Thus, the delay value (to one decimal point) transmitted by the aerial message software to aircraft 2 is t+50 ms, which equals a total time delay value of 86.4 ms. The time delay for each aircraft is calculated using the same formula and the constant time delay corresponding to each aircraft position.

Figure 29:
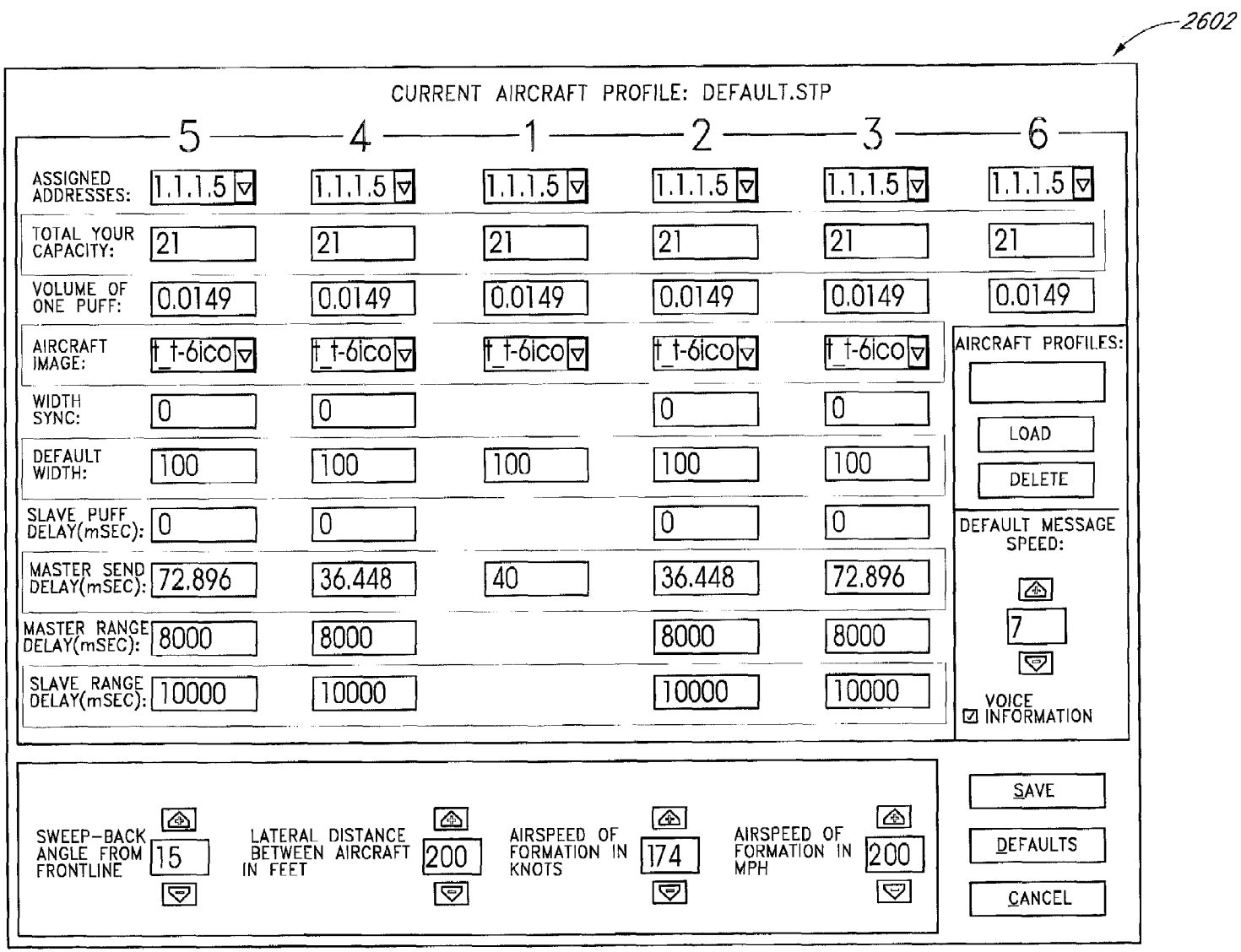
FIG. 29 illustrates an example aircraft profile screen according to one embodiment of the invention, with the aircraft using a V flight formation.

For example, the time delay associated with aircraft 5 is 72.8 ms+300 ms, which equals 372.8 ms. FIG. 29 shows the value of t for each aircraft in this example.

Therefore, for example, the aerial message software sends a data packet to aircraft 5 with the following format and data:

1.1.1.5, 1, 372.8 ms, 1 s

This informs aircraft 5 to make a vapor puff 372.8 ms after receiving the data packet. A clock in aircraft 5 begins a countdown from 372.8 ms, and when the clock reaches zero, the solenoid valve is opened for 1 second. At the same time that the data packet is sent to aircraft 5, a clock in the aerial message software, which is associated with a graphical representation of aircraft 5, also begins a countdown from 372.8 ms. When the associated graphical clock reaches zero, the graphic of aircraft 5 displays a vapor puff trailing from the graphical representation for 1 second. Thus, the graphical representation of each aircraft is synchronized with the actual physical aircraft.

This process continues for each column in the first character data row. Once the process reaches the end of the first character data row, the process waits until the row clock reaches zero, and then proceeds to the second character data row. The faster the character speed set by the user, the shorter the wait between processing character data rows. In other words, there is an approximately linear relationship between character speed and the speed at which the aerial message software reads each row of character data. When the process proceeds to the second character data row, the software resets the row clock to a value associated with the currently specified character speed, and advances the simulated aerial message in the simulation window of the message printing screen. The software also resets the clocks associated with the graphical representations of each aircraft. The process is then repeated for each row until the end of the aerial message file is reached and the aerial message has been printed.

VII. Alternative Embodiments

Figure 27A:
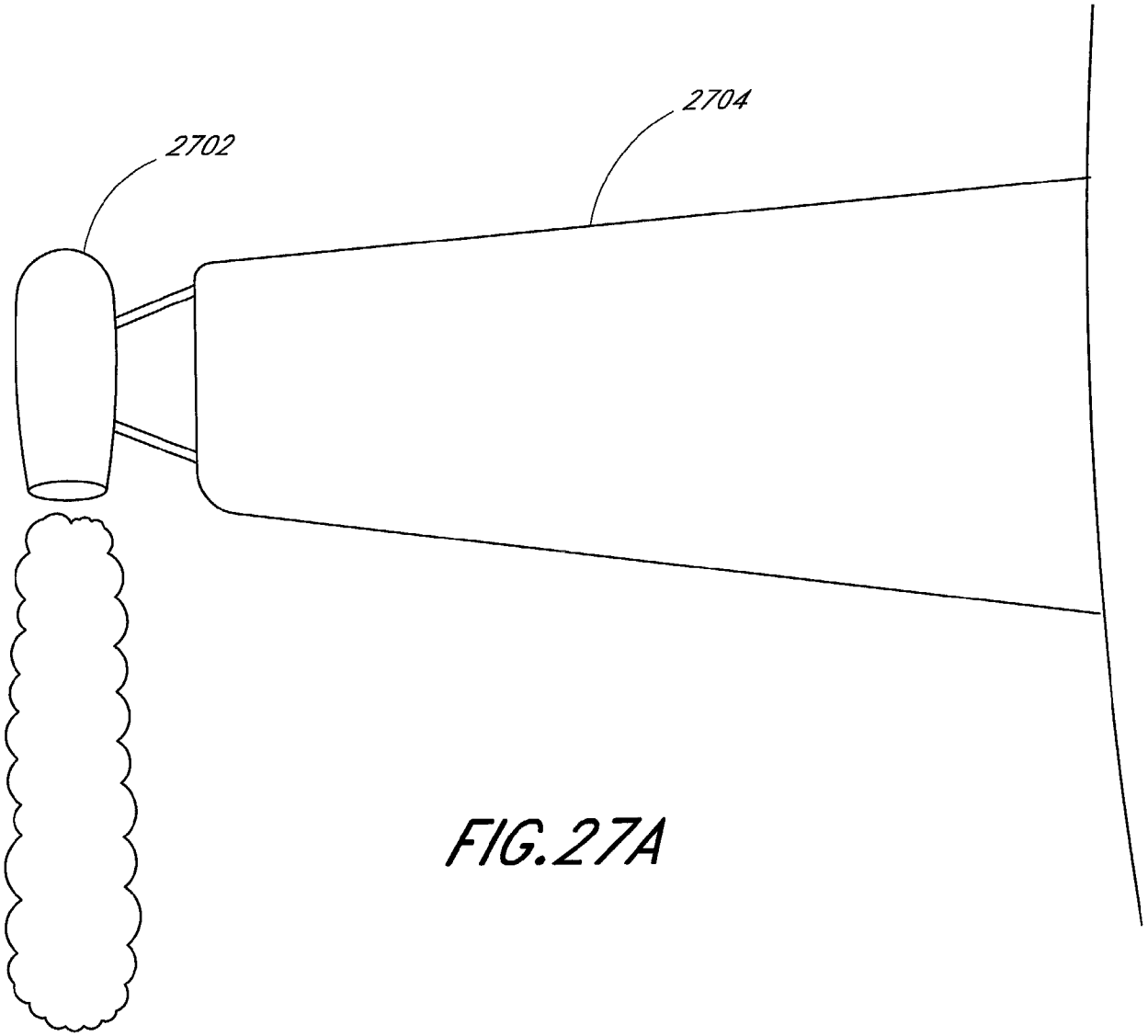
FIG. 27A illustrates an external heat source for use in creating colored aerial messages according to one embodiment of the invention.
Figure 27B:
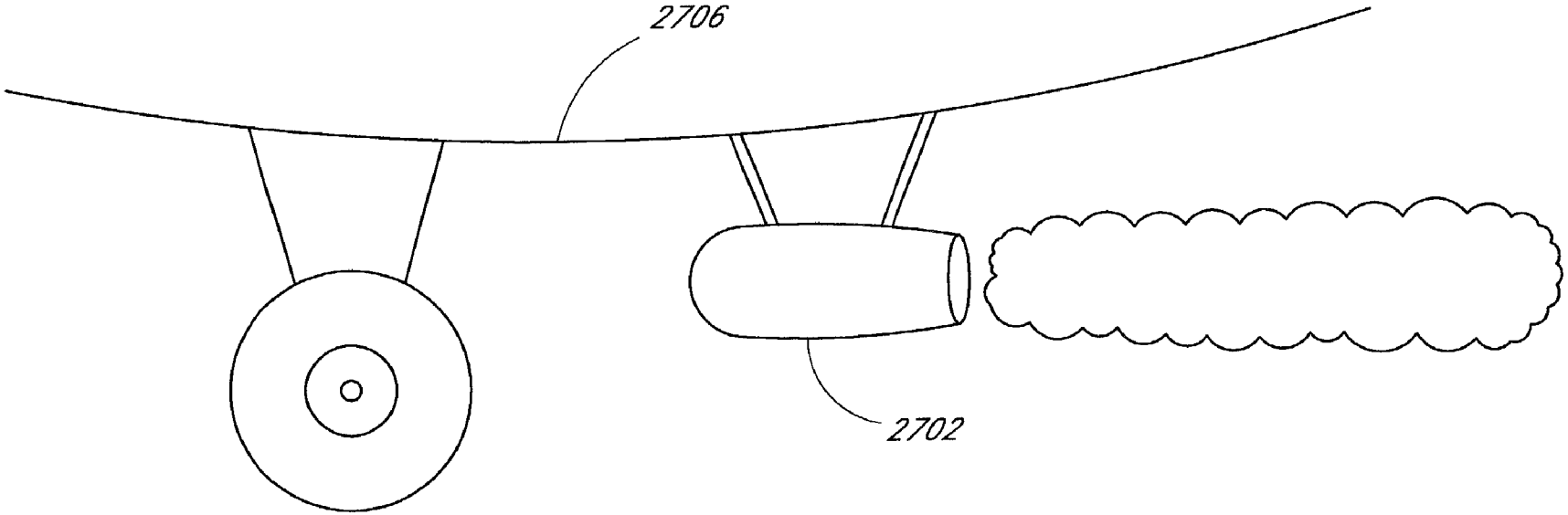
FIG. 27B illustrates an external heat source for use in creating colored aerial messages according to one embodiment of the invention.

As indicated above, the disclosed systems and methods are useful in a variety of embodiments. In one embodiment, black and white images, such as, for example, black and white photographs, are created using lighter and darker vapor puffs. As illustrated in FIG. 27A, the systems and methods of the present invention may be used with an external heat source 2702, such as, for example, a portable jet engine, attached to the wing 2704 of the aircraft or on the bottom 2706 of the aircraft. The external heat source embodiment is particularly useful in creating colored vapor puffs, which generally requires a higher exhaust temperature, and advantageously does not interfere with or clog the main exhaust system of the aircraft.

Figure 28:
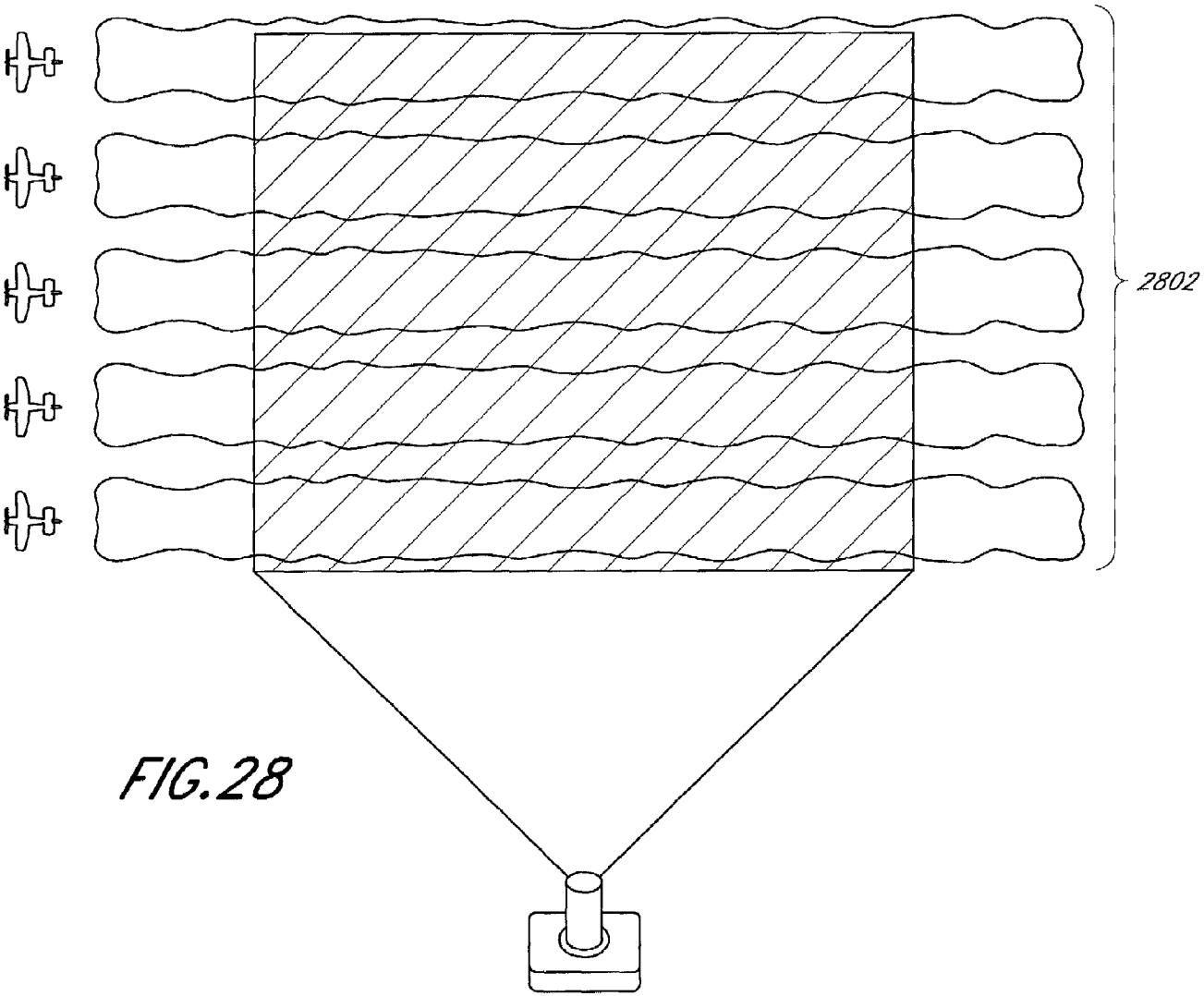
FIG. 28 illustrates an example aerial vapor screen according to one embodiment of the invention.

In yet further embodiments (see FIG. 28), the systems and methods may be used to create an aerial vapor screen 2802 (which is similar to an outdoor movie screen) for use in projecting images (including still images and/or video) onto the aerial vapor screen. The screen is created by the aircraft emitting streaks of continuous vapor emissions over a defined screen area. Alternatively, helicopters may be used to emit vapor material for the aerial vapor screen. In this embodiment, the rotation of the helicopter blades assists in dispersing the vapor emissions into a uniform vapor screen. To create an aerial vapor screen sufficiently dense to display images, the aircraft make multiple passes over the defined screen area. Alternatively, multiple fleets of aircraft may be used to create the desired density for the aerial vapor screen. After creation of the aerial vapor screen, images are projected onto the screen. Because lower lighting conditions facilitate visibility of the projected images from the ground, the aerial vapor screen embodiment is preferably implemented at dusk or at nighttime. The images may be projected using a helicopter or plane located below the vapor screen and/or using a projector from the ground. In the alternative, a helicopter or plane located above the aerial vapor screen may use lasers to project images from above the vapor screen, creating laser images that are visible from the ground. In this embodiment, the images are preferably projected in a manner to avoid viewers looking directly into the line of the laser fire, such as, for example, projecting the images over open water where viewers from the beach see the laser images from an angle.

VIII. Conclusion

Although this invention has been described in terms of certain preferred embodiments, other embodiments that are apparent to those of ordinary skill in the art, including embodiments that do not provide all of the benefits and features set forth herein, are also within the scope of this invention. It will also be understand by one of skill in the art that the flow charts provided herein are for illustrative purposes only, and that various states of the flow charts may be interchanged and still retain the inventiveness of the present invention. Accordingly, the scope of the present invention is defined only by reference to the appended claims.

What is claimed is:

1. A system for creating aerial messages using a plurality of aircraft, the system comprising:

a logic and processing unit configured to provide a user interface for creating aerial messages using a plurality of aircraft, wherein the logic and processing unit is located in a master aircraft and sends data to and receives data from a master controller;

a master controller located in the master aircraft, wherein the master controller is a node on a wireless local area network (LAN) and is configured to transmit data over the LAN to a plurality of slave controllers and to receive data from each of the plurality of slave controllers;

a plurality of slave controllers, each slave controller designed to be located in one of a plurality of slave aircraft, wherein each of the slave controllers is a node on the wireless LAN and is configured to receive data from and transmit data to the master controller; and a plurality of vapor puff creation systems, each vapor puff system designed to be located in one of the plurality of aircraft.

2. The system of claim 1, wherein the master controller transmits data using a single frequency.

3. The system of claim 1, wherein the master controller transmits data using unlicensed spread spectrum radio frequencies.

4. The system of claim 3, wherein master controller transmits data using a frequency hopping spread spectrum system.

5. The system of claim 3, wherein master controller transmits data using a direct sequence spread spectrum system.

6. The system of claim 1, wherein each of the plurality of slave controllers is assigned a unique network address.

7. The system of claim 6, wherein the unique network address of each slave controller is dynamically assigned by the logic and processing unit.

8. The system of claim 1, wherein the plurality of aircraft fly in a frontline formation.

9. The system of claim 1, wherein the plurality of aircraft fly in an echelon formation.

10. The system of claim 1, wherein the plurality of aircraft fly in a V-shaped formation.

11. The system of claim 1, wherein the plurality of aircraft fly in a wedge formation.

12. The system of claim 1, wherein the plurality of aircraft fly in a vertically descending echelon formation.

13. The system of claim 1, wherein the wireless LAN is an Ethernet network.

14. The system of claim 1, wherein the logic and processing unit is further configured to determine when one of the plurality of slave aircraft travels out of a receiving range.

15. The system of claim 14, wherein the logic and processing unit is further configured to notify a user of the computer when one of the plurality of slave aircraft travels out of the receiving range.

16. The system of claim 1, wherein the aerial message is an alphanumeric message.

17. The system of claim 1, wherein the aerial message is a graphical image.

18. The system of claim 1, wherein the aerial message is a symbol.

19. A method for producing aerial messages, the method comprising:

transmitting puff data from a computer to a plurality of controllers located in a plurality of aircraft, the puff data including an indication of whether each of the plurality of aircraft is to emit a vapor puff; and receiving status data at the computer from each of the plurality of controllers, the status data indicating whether the vapor puff was emitted by each of the plurality of aircraft.

20. The method of claim 19, wherein the computer is a laptop device.

21. The method of claim 19, wherein the computer is a handheld device.

22. The method of claim 19, wherein the puff data includes a time delay indicating how long to wait before emitting the vapor puff.

23. The method of claim 19, wherein the puff data includes a duration measurement indicating how wide to make the vapor puff.

24. The method of claim 19, wherein the vapor puff is a visible fog.

25. The method of claim 24, wherein the vapor puff is colored.

26. The method of claim 19, wherein the status data includes an indication of the vapor level remaining in a vapor tank located in each of the plurality of aircraft.

27. A system for producing aerial messages using a plurality of aircraft, the system comprising:

a main computer configured to provide a user interface for use in producing aerial messages using a plurality of aircraft, wherein the main computer operates as a node on a wireless network to transmit data to and receive data from a plurality of controllers;

a plurality of controllers, each controller designed to be located in one of the plurality of aircraft, wherein each controllers is a node on the wireless network and wherein each controllers is configured to process data received from the main computer; and a plurality of vapor puff creation systems, each vapor puff creation system designed to be located in one of the plurality of aircraft.

28. The system of claim 27, wherein the main computer is located in one of the plurality of aircraft.

29. The system of claim 27, wherein the main computer is located at a ground control station.

30. A system for creating aerial messages using a plurality of aircraft, the system comprising:

a master controller, wherein the master controller is a node on a wireless local area network (LAN) and is configured to transmit data over the LAN to a plurality of slave controllers and to receive data from each of the plurality of slave controllers; and a plurality of slave controllers, each slave controller designed to be located in one of a plurality of aircraft, wherein each of the slave controllers is a node on the wireless LAN and is configured to receive data from and transmit data to the master controller; each of said slave controllers having at least one output control line for operating a vapor puff creation system;

wherein the data transmitted by said master controller to said slave controller comprises instructions to control vapor puff creation systems and the data received from said plurality of slave controllers comprises status information.

31. The system of claim 30 further comprising a logic and processing unit configured to provide a user interface for creating aerial messages using a plurality of aircraft, wherein the logic and processing unit is located in the master aircraft and sends data to and receives data from the master controller.

32. The system of claim 30 wherein the data indicates whether a puff was emitted by the aircraft.

33. The system of claim 30 wherein the data indicates an amount of vapor material remaining in the aircraft.

34. The system of claim 30 wherein the data indicates whether the aircraft is actively on the network.

35. The system of claim 30 wherein the data indicates whether a pump was turned on.

36. The system of claim 30 wherein the data indicates whether a pump was turned off.

37. The system of claim 30 wherein the data indicates a puff is to be produced.

38. The system of claim 30 wherein the data indicates a time delay.

39. The system of claim 30 wherein the data indicates a pump is to be turned on.

40. The system of claim 30 wherein the data indicates a pump is to be turned off.

* * * * *

UNITED STATES PATENT AND TRADEMARK OFFICE

CERTIFICATE OF CORRECTION

PATENT NO. : 7,082,706 B1
APPLICATION NO. : 09/874565
DATED : August 1, 2006
INVENTOR(S) : Gregory Stinis et al.

It is certified that error appears in the above-identified patent and that said Letters Patent is hereby corrected as shown below:

At Title Page, column 1 (Assignee) (73), line 1, delete "Skytypers, Inc., Las Vegas, NV (US)" and insert -- Skytypers Inc. dba Skywriters USA Las Vegas, NV (US) --, therefor.

At column 25, line 8 (Approx.) Delete "$b^2 = c^2 a^2$" and insert -- $b^2 = c^2 - a^2$ --, therefor.

Signed and Sealed this

Ninth Day of January, 2007

JON W. DUDAS
*Director of the United States Patent and Trademark Office*